US010703519B2

(12) United States Patent
Ceré

(10) Patent No.: US 10,703,519 B2
(45) Date of Patent: Jul. 7, 2020

(54) WRAPPING MACHINE

(71) Applicants: AETNA GROUP S.P.A., Verucchio (IT); ROBOPAC S.P.A., Acquaviva-Gualdicciolo (IT)

(72) Inventor: Mauro Ceré, Loiano (IT)

(73) Assignees: AETNA GROUP S.P.A., Verucchio (RN) (IT); ROBOPAC S.P.A., Acquaviva Gualdicciolo (SM)

( * ) Notice: Subject to any disclaimer, the term of this patent is extended or adjusted under 35 U.S.C. 154(b) by 240 days.

(21) Appl. No.: 15/577,668

(22) PCT Filed: May 27, 2016

(86) PCT No.: PCT/IB2016/053115

§ 371 (c)(1),
(2) Date: Nov. 28, 2017

(87) PCT Pub. No.: WO2016/193875

PCT Pub. Date: Dec. 8, 2016

(65) Prior Publication Data

US 2018/0162567 A1 Jun. 14, 2018

(30) Foreign Application Priority Data

May 29, 2015 (IT) ..... 102015000019498

(51) Int. Cl.
*B65B 11/02* (2006.01)
*B65B 11/58* (2006.01)
(Continued)

(52) U.S. Cl.
CPC ..... *B65B 11/025* (2013.01); *B65B 11/58* (2013.01); *B65B 11/585* (2013.01);
(Continued)

(58) Field of Classification Search
CPC ..... B65B 11/008; B65B 11/025; B65B 11/58; B65B 13/12; B65B 21/245; B65B 27/04;
(Continued)

(56) References Cited

U.S. PATENT DOCUMENTS 1,983,473 A * 12/1934 Leaver, Jr. ..... B65B 13/12 100/7
2,124,770 A * 7/1938 Evans ..... B65B 13/12 100/28

(Continued)

FOREIGN PATENT DOCUMENTS

DE 10049298 A1 * 4/2002 ..... B65B 11/025
EP 1 431 185 6/2004

(Continued)

OTHER PUBLICATIONS

International Search Report dated Aug. 31, 2016 in International (PCT) Application No. PCT/IB2016/053115.

(Continued)

*Primary Examiner* — Stephen F. Gerrity
(74) *Attorney, Agent, or Firm* — Wenderoth, Lind & Ponack, L.L.P.

(57) ABSTRACT

A wrapping machine for wrapping material around a load includes a wrapping unit to wrap a portion of the material around the load and a supplying unit to supply the material portion to the wrapping unit. The wrapping unit includes wrapping device to unwind the material portion from the supplying unit and wrap it around the load. The wrapping unit includes a supporting ring, rotating around a wrapping axis and provided with a plurality of wrapping rollers, and an unwinding arm having a first end rotatably fixed to the support ring and a second end supporting at least one unwinding roller to abut and guide the portion of material towards the load during wrapping. The unwinding arm is (Continued)

movable to move the unwinding roller to/from the load during wrapping.

20 Claims, 17 Drawing Sheets

(51) Int. Cl.

| | |
|---|---|
| ***B65B 21/24*** | (2006.01) |
| ***B65B 35/44*** | (2006.01) |
| ***B65B 41/14*** | (2006.01) |
| ***B65B 41/18*** | (2006.01) |
| ***B65B 59/02*** | (2006.01) |
| *B65B 11/00* | (2006.01) |

(52) U.S. Cl.
CPC ..... *B65B 21/245* (2013.01); *B65B 35/44* (2013.01); *B65B 41/14* (2013.01); *B65B 41/18* (2013.01); *B65B 59/02* (2013.01); *B65B 2011/002* (2013.01); *B65B 2210/18* (2013.01)

(58) Field of Classification Search
CPC . B65B 41/14; B65B 2210/16; B65B 2210/18; B65B 11/585; B65B 35/44; B65B 41/18; B65B 2011/002
USPC ..... 53/588, 210, 218
See application file for complete search history.

(56) References Cited

U.S. PATENT DOCUMENTS

| | | | | | |
|---|---|---|---|---|---|
| 2,705,914 | A * | 4/1955 | Cranston, Sr. | B65B 13/12 | 100/28 |
| 3,233,385 | A * | 2/1966 | Lyon | B65B 13/10 | 53/588 |
| 3,309,839 | A * | 3/1967 | Lyon | B65B 13/12 | 53/588 |
| 4,126,983 | A * | 11/1978 | Ito et al. | B65B 13/12 | 100/27 |
| 4,317,322 | A | 3/1982 | Lancaster et al. | | |
| 4,989,397 | A * | 2/1991 | Tomac et al. | B65B 27/08 | 100/7 |
| 5,027,581 | A * | 7/1991 | Kovacs | B65B 11/025 | 53/399 |
| 5,123,230 | A * | 6/1992 | Upnnann | B65B 11/025 | 53/218 |
| 6,745,544 | B2 * | 6/2004 | Matsumoto et al. | B65B 11/008 | 53/176 |
| 2003/0024213 | A1 | 2/2003 | Cere' | | |
| 2004/0055252 | A1 * | 3/2004 | Suolahti | B65B 11/025 | 53/399 |
| 2004/0107678 | A1 * | 6/2004 | Cere | B65B 21/245 | 53/588 |
| 2004/0118086 | A1 | 6/2004 | Cere | | |
| 2005/0178084 | A1 | 8/2005 | Haloila | | |
| 2006/0213155 | A1 * | 9/2006 | Forni et al. | B65B 11/025 | 53/588 |
| 2007/0175179 | A1 | 8/2007 | Haloila | | |
| 2012/0151879 | A1 * | 6/2012 | Ghezzi | B65B 11/025 | 53/448 |
| 2012/0260609 | A1 | 10/2012 | Kivelä | | |
| 2016/0200470 | A1 * | 7/2016 | Zoboli | B65B 21/245 | 53/441 |

FOREIGN PATENT DOCUMENTS

| | | |
|---|---|---|
| EP | 1 449 771 | 8/2004 |
| EP | 1 462 366 | 9/2004 |
| EP | 2 204 323 | 7/2010 |
| GB | 2 076 772 | 12/1981 |
| JP | 02072011 A * | 3/1990 |
| WO | 2011/051572 | 5/2011 |

OTHER PUBLICATIONS

Written Opinion of the International Searching Authority dated Aug. 31, 2016 in International (PCT) Application No. PCT/IB2016/053115.

* cited by examiner

Fig. 26
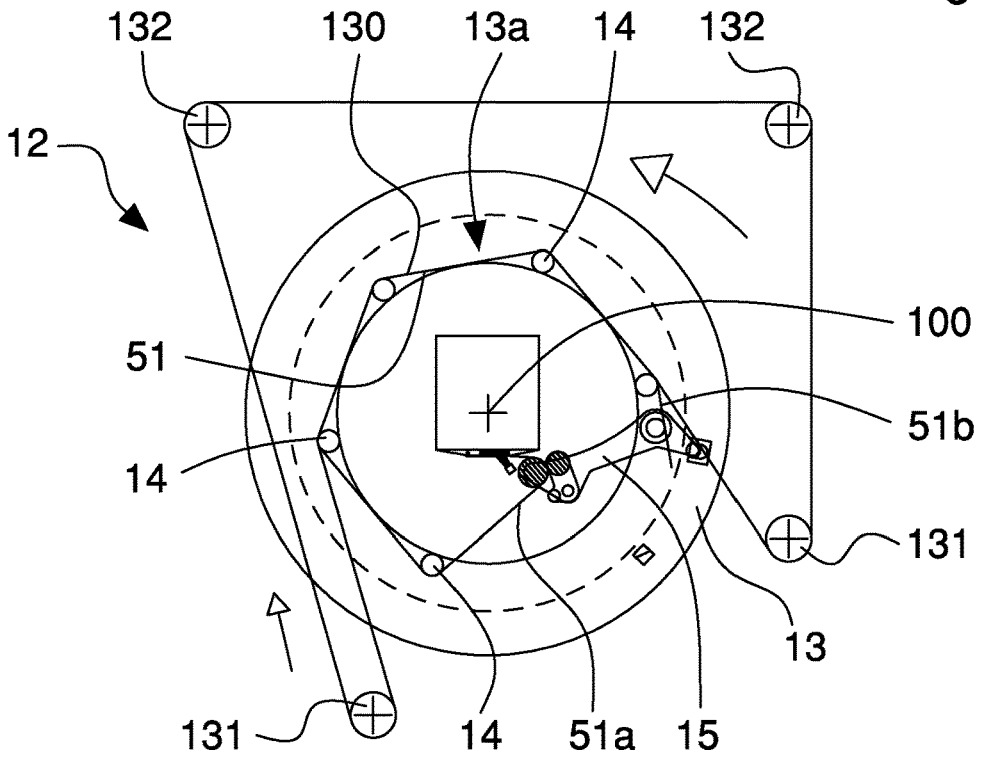
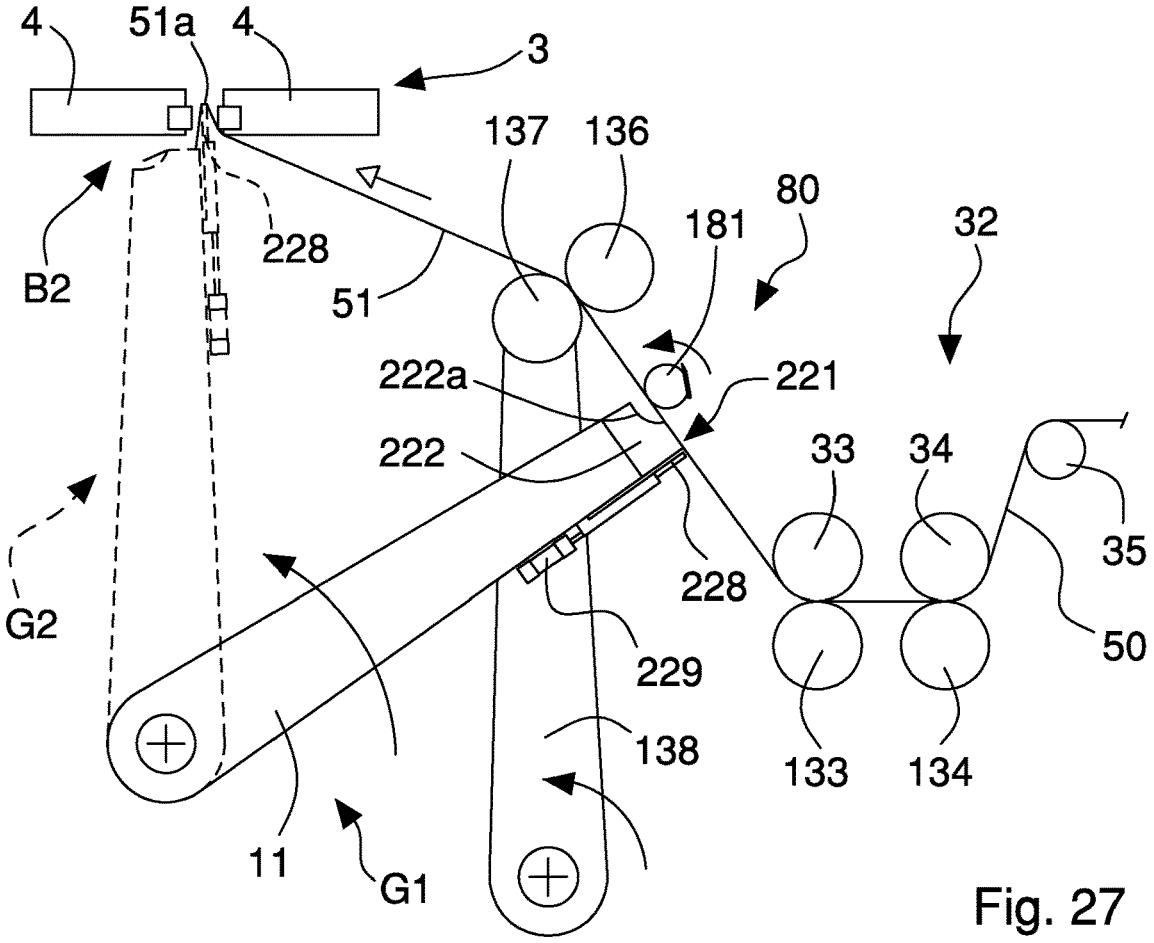
Fig. 27

WRAPPING MACHINE

BACKGROUND

Field

The invention concerns machines for wrapping products with a plastic film and in particular refers to a wrapping machine suitable to wrap with an extensible plastic film a load made of a product or a group of products, for example arranged on a pallet or to be packaged in bundles.

Description of the Related Art

The known wrapping machines generally include an unwinding unit that receives and supports a film reel and moving means that support and move said wrapping unit. In fact, the film is unwound from the reel and is wrapped around the load in such a way to form a series of stripes or bands superimposed thanks to the combination of a movement in the vertical direction of the unwinding unit and the relative rotation between the latter and the load.

In the wrapping machines having a rotating table, the moving means include an upright or column along which a carriage vertically moves, which supports the unwinding unit. The load is positioned on the rotating table and rotates with the latter around a vertical wrapping axis.

In the wrapping machines having a horizontal rotating ring or a rotating arm, the load remains still during the wrapping, while the unwinding unit is moved with respect to the load both rotating around, and translating along, the vertical wrapping axis. In the wrapping machines having a horizontal rotating ring, the moving means comprise a rotating ring that supports the unwinding unit and that rotates around the wrapping axis and moves vertically and in parallel thereto. In the wrapping machines with a rotating arm, the moving means comprise a vertical arm that rotates around the wrapping axis and along which the unwinding unit is movable.

In the wrapping machines having a vertical rotating ring, the load is linearly moved by suitable transport means during the wrapping through the ring, while the moving means comprise a ring that rotates around a horizontal wrapping axis and supports the unwinding unit.

Finally, in the self-propelled wrapping machines or wrapping robots, the moving means comprise a vertical column or upright of the machine that moves together with the latter around the load and along which the unwinding unit is movable.

The unwinding unit, besides receiving and supporting the film reel, is typically provided with a couple of pre-stretching rollers, that unwind the film from the reel and stretch or elongate it, and one or more return rollers that deflect the film towards the product or group of products.

The wrapping procedure provides an initial step in which an initial flap of the film is manually or automatically brought near the load by means of an arm with a pliers and then the start of the wrapping, the first strips or bands of film being superimposed to the initial flap in order to block it against the load. At the end of the wrapping, the film is cut, so obtaining two flaps of which one is the terminal flap of the wrapping and is fixed to the load (for example it is welded or glued or inserted under previous film strips), the other one is the initial flap of a successive wrapping and is held by suitable grabbing pliers of the machine.

A drawback of the known above-described wrapping machines is that these machines do not allow positioning the film unwound from the reel in a precise and repeatable way on the load (single product or group of products). Said machines do not allow applying a portion of film having a preset length around the load. Consequently, for the wrapping the above-mentioned wrapping machines do not allow using printed films having writings, drawings, decorations or the same, which in the final wrapping are placed in desired positions.

Another drawback of the known wrapping machines is the short operative autonomy due to the small dimensions of the film reel that is supported and held in the unwinding unit, which rotates and/or translates. Therefore, frequent wrapping machine stops and related production interruptions for more or less extended times are required for replacing the depleted film reels.

SUMMARY OF THE EMBODIMENTS

An object of the present invention is to improve the wrapping machines arranged for wrapping with films, tapes, bands a load, formed by a product or a group of products. Another object is to achieve a wrapping machine that allows wrapping a load with a flexible and wrappable material in the form of a film or tape or band or strip, positioning the said material in a precise and repeatable way around the load.

A further object is to provide a wrapping machine that allows wrapping a load using a flexible and wrappable printed material, for example a plastic film, in particular positioning a material portion having a preset length around the said load in a precise and repeatable way.

Still another object is to achieve a versatile and flexible wrapping machine that allows wrapping products or groups of products having different sizes and dimensions in a precise and efficient way, without requiring complicated and difficult adjustment and/or setting operations.

Another further objective is to supply a wrapping machine having a high operation autonomy, allowing replacing the depleted film reels without the need to stop the operation.

These and further objectives are achieved by a wrapping machine according to one or more of the following claims.

BRIEF DESCRIPTION OF THE DRAWINGS

The invention could be better understood and carried out with reference to the attached drawings that show some exemplary and non-limitative embodiments, wherein:

FIG. 26 is a schematic side view of another variant of the wrapping machine of the invention showing wrapping means of the load;

FIG. 27 is a partial side view of another further variant of the wrapping machine of the invention showing unwinding means and cutting means of the supplying unit;

DETAILED DESCRIPTION

Figure 2:
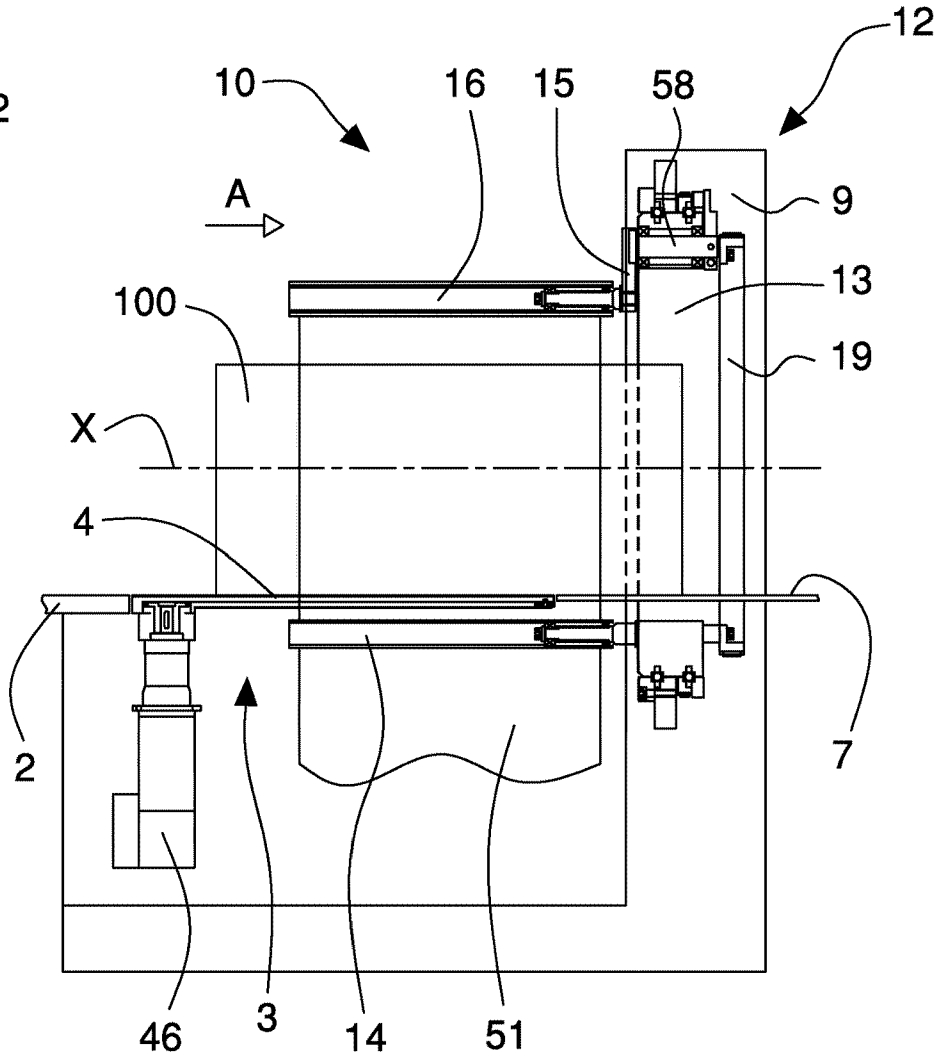
FIG. 2 is a schematic front view of the wrapping machine of FIG. 1 in an operating step.

With reference to FIGS. 1 to 20, a wrapping machine 1 according to the invention is shown that is arranged to wrap a flexible and wrappable material, for example a plastic material film, a cold-extensible plastic film or a tape or a band or strip made of plastic material, around a load 100, for example a product, an article, an object or a plurality of products or grouped articles. The wrapping machine 1 comprises supporting means 3 of the load 100, a wrapping unit 10, a supplying unit 30 of the flexible and wrappable material 50 and first gripping means 4 of the material to the load 100.

More precisely, the supporting means 3 are arranged for receiving and supporting the load 100 during the wrapping, the wrapping unit 10 is arranged for wrapping a material portion 51 having a preset length around the load 100 and the supplying unit 30 of the flexible and wrappable material 50 is arranged for supplying the material portion 51 having a preset length to the wrapping unit 10, separated from the material 50 connected and unwound from a respective reel 55.

In the example shown in the figures, the flexible and wrappable material is a film 50 made of extensible plastic material that is wrappable, for example according to a plurality of overlapping bands or turns around a load 100 formed, for example, by a product having an extended prismatic shape. The wrapping of load 100 can be carried out by maintaining the load still or static inside the wrapping unit 10 or by moving the said load 100 through the wrapping unit 10 along a longitudinal advancing direction A.

The first gripping means 4, arranged adjacent to the supporting means 3 and the load 100, are arranged for blocking an initial flap 51*a* of said material portion 51 during the wrapping.

The length of the material portion 51 is calculated according to shape and/or dimensions of the load 100 to be wrapped and according to the desired number of film turns to be applied to the load 100.

The wrapping unit 10 comprises an insertion arm 11 movable and arranged for grabbing the initial flap 51*a* coming out from the supplying unit 30 and for transferring it to the first gripping means 4 so as to be grabbed and blocked by the latter, in an initial setting step of the wrapping. The wrapping unit 10 also comprises wrapping means 12 to unwind the material portion 51 from the supplying unit 30 and to wrap it around the load 100.

The wrapping machine 1 includes first conveyor means 2 for supporting and moving the load 100 entering along the advancing direction A and for transferring the load to the supporting means 3, and second conveyor means 7 for receiving the wrapped load 100 exiting the wrapping unit 10 and moving it out of the wrapping machine 1.

With particular reference to FIGS. 1 to 6, in the shown embodiment the first gripping means 4 are integrated with the supporting means 3 and comprise two supporting elements 4 of the supporting means 3, said supporting elements 4 being adjacent and opposed and forming a supporting plane M for the load 100. The supporting elements 4 are also movable, in particular transversally to the advancing direction A, between a closing position B1 and an opening position B2. In the closing position B1, the supporting elements 4 abut against each other in order to block the initial flap 51*a* of the material portion 51, in particular during the wrapping. In the opening position B2, the supporting elements 4 are mutually spaced apart to allow the initial flap 51*a* to be inserted or released, as better explained in the following of the description.

Figure 5:
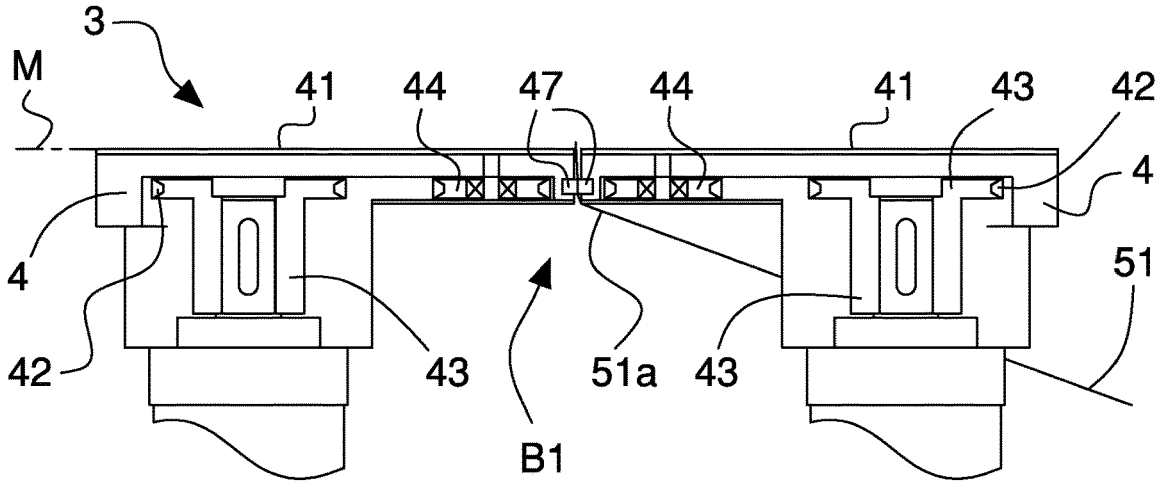
FIG. 5 is an enlarged and partial side view of the supporting means in a closing position.
Figure 6:
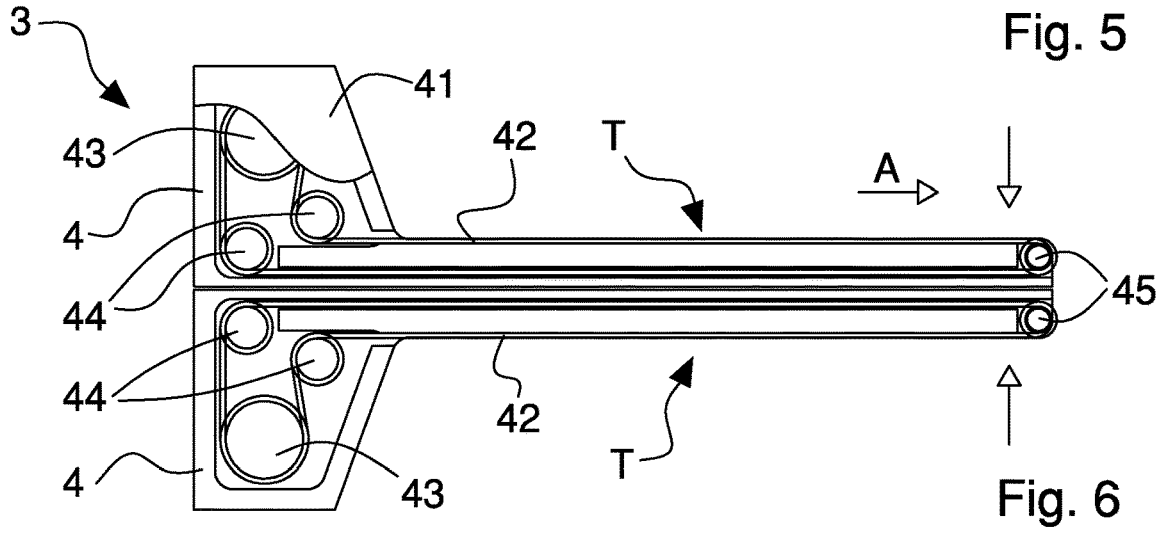
FIG. 6 is a top view of the supporting means in the closing position.

Each supporting element 4 comprises an abutting portion 47 having an elongated shape (for example a strip made of elastic material) and arranged parallel to the advancing direction A. In the closing position B1 of supporting means 3, the abutting portions 47 of the two supporting elements 4 are against each other so as to hold and block the initial flap 51*a* that is inserted and interposed therebetween (FIG. 5).

Each supporting element 4 comprises a supporting wall 41, substantially horizontal, suitable to support the load 100 and forming the supporting plane M.

Moreover, like in the shown embodiment, each supporting element 4 can include a respective first moving belt 42 that is flexible, endless and arranged to be abutted along an operative tract T by the material portion 51 during the wrapping. The first belt 42 is driven in such a way to move, at the operative tract T, along the advancing direction A together with the load 100 exiting the wrapping unit 10 in order to allow the supporting elements 4 disengaging from the material wrapped around the load 100.

The first belt 42 is wrapped around a plurality of pulleys 43, 44, 45 rotatable around respective axes that are orthogonal to the supporting wall 41, i.e. to the supporting plane M. The first belt 42 has an abutting surface that is substantially orthogonal to the supporting wall 41 and that can be engaged in the operative tract T by the material portion 51 wrapped around the group 100 of products. In the operative tract T, the first belt 42 comes out from the respective supporting element 4 so as to be abutted by the portion 51 of the material 50.

Inside the respective supporting element 4, the first belt 42 is wrapped around a first pulley 43, rotatably driven by a respective first motor 46, a couple of second return pulleys 44 and a third return pulley 45, the return pulleys 44, 45 being rotatable and idle.

In a variant of the wrapping machine 1, not shown, the supporting elements 4 of the supporting means 3 (that act also as first gripping means of the initial flap 51*a* of the portion 51) do not include movable belts abutting the flexible and wrappable material. In this case, the wrapped load is disengaged from the supporting means 3 because of dimensions and shape of the supporting elements 4 that facilitate the sliding of the material, i.e. of the portion 51 of the material 50.

Figure 3:
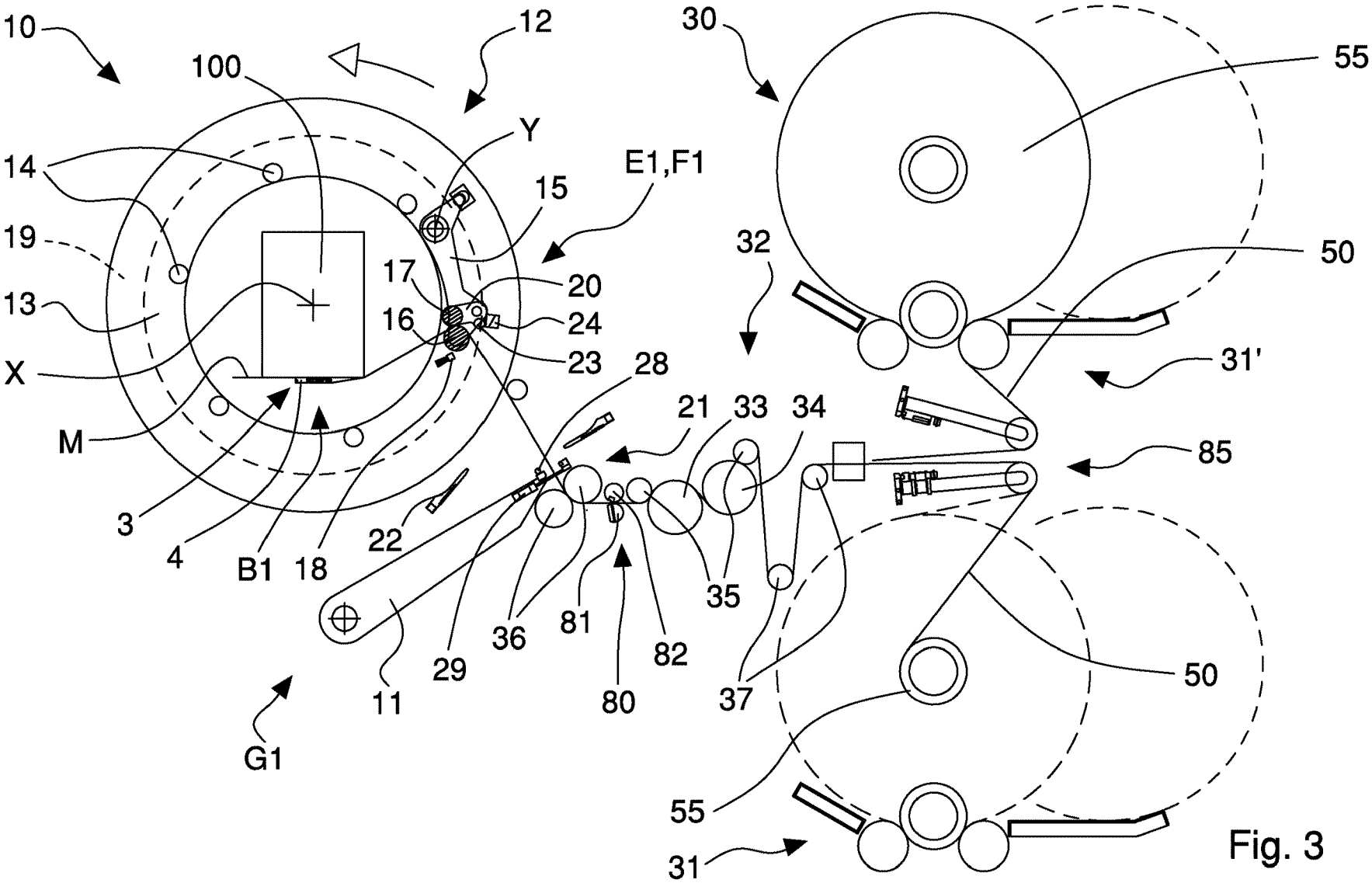
FIG. 3 is a partial side view of a wrapping unit and a supplying unit of the machine of FIG. 1.
Figure 4:
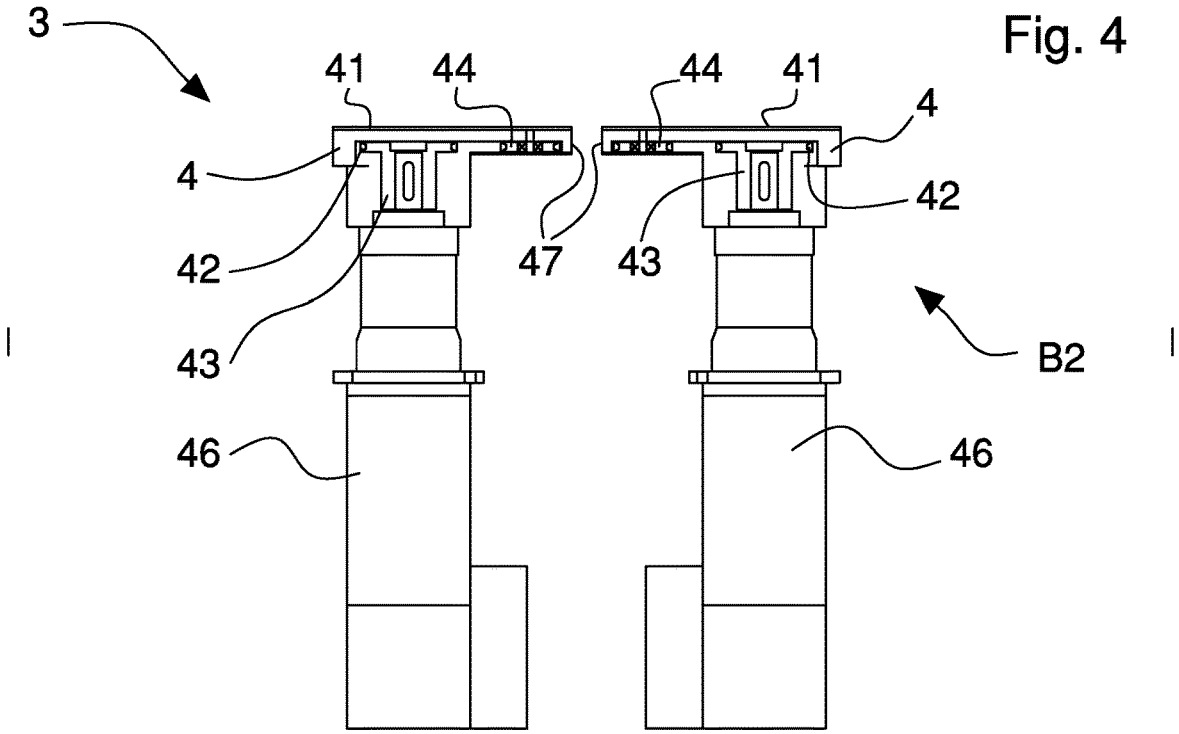
FIG. 4 is a side view of supporting means of the wrapping machine of FIG. 1 in an opening position.

With particular reference to FIGS. 2 and 3, the wrapping means 12 of the wrapping unit 10 include a supporting ring 13 rotatable around a wrapping axis X parallel to the advancing direction A, in particular substantially horizontal, a plurality of wrapping rollers 14 mounted in a cantilever way on the supporting ring 13 and an unwinding arm 15. The wrapping rollers 14 are mounted on the supporting ring 13 angularly spaced apart and rotating around respective longitudinal axes, parallel to the wrapping axis X, and extend from the supporting ring 13 in the advancing direction A, for example in an opposite direction with respect to the advancing direction of the load 100 through the wrapping unit 10.

Each wrapping roller 14 comprises a respective cylindrical element having a length equal to or longer than the width of the material 50 and it is fixed to the supporting ring 13 so as to freely rotate around the respective longitudinal axis, parallel to the wrapping axis X.

The unwinding arm 15 has a first end 15*a* rotatably fixed to the supporting ring 13 around a respective rotating axis Y and a second end 15*b* supporting one or more unwinding rollers 16, 17 rotating around the respective longitudinal axes and arranged for abutting and guiding the material portion 51 towards the load 100 during the wrapping thereof, the unwinding arm 15 being movable in order to bring near and/or move away the unwinding roll(s) 16, 17 to/from said load 100 during the wrapping.

In the shown embodiment, the second end 15*b* of the unwinding arm 15 is provided with a couple of unwinding rollers 16, 17 arranged to abut opposite sides of the material portion 51 when the initial flap 51*a* of the material portion 51 is grabbed and held by the first gripping means 4 in the closing position B1.

The unwinding rollers 16, 17 comprise respective cylindrical elements having a length equal to or longer than the width of the flexible and wrappable material 50. At least the first unwinding roller 16 is externally coated with a layer of elastomeric or similar material in order to abut with friction and therefore hold the material portion 51 during the wrapping around the load 100 thus guaranteeing an appropriate wrapping tension. The first unwinding roller 16 is also provided with an internal clutch in order to offer an adjustable resistance to the rotation, which allows maintaining the film under tension or traction during the wrapping on the product group.

The supporting ring 13 is rotatably supported by frame means 9 of the machine and is rotated by respective actuating means, comprising for example a rotating electric motor not shown.

In the shown embodiment, the supporting ring 13 of the wrapping means 12 is substantially vertical, i.e. it is rotatable around a wrapping axis X substantially horizontal and parallel to the supporting plane M of the load 100.

As better explained in the following of the description, when the supporting ring 13 rotates around the wrapping axis X in a first wrapping step, it unwinds and draws the material portion 51 from the supplying unit 30 and at the same time, by means of the unwinding arm 15, wraps a first tract of the portion 51, provided with the initial flap 51*a*, around the load 100 and wraps a second tract of the material portion 51, provided with a terminal flap 51*b*, around the wrapping rollers 14. In a second wrapping step, by means of the unwinding arm 15, the supporting ring 13 by rotating wraps the second tract of the material portion 51, drawn and unwound from the wrapping rollers 14, around the load 100.

As shown in FIGS. 3, 7, 9 and 10, the wrapping means 12 can be positioned along a direction orthogonal to the supporting plane M, substantially vertical, in different working positions according to the dimensions of the loads or products 100 to be wrapped. In this way, the wrapping means 12 are substantially centered with respect to the wrapping axis X in order to allow an optimal wrapping of the load with the portion 51

In case of loads having big dimensions, for example a box-shaped product (FIG. 3) the wrapping means 12 are positioned in such a way that the rotational axis X is at a respective distance from the supporting plane M formed by the supporting means 3 so as to be correctly centered and positioned inside the supporting ring 13.

Figure 7:
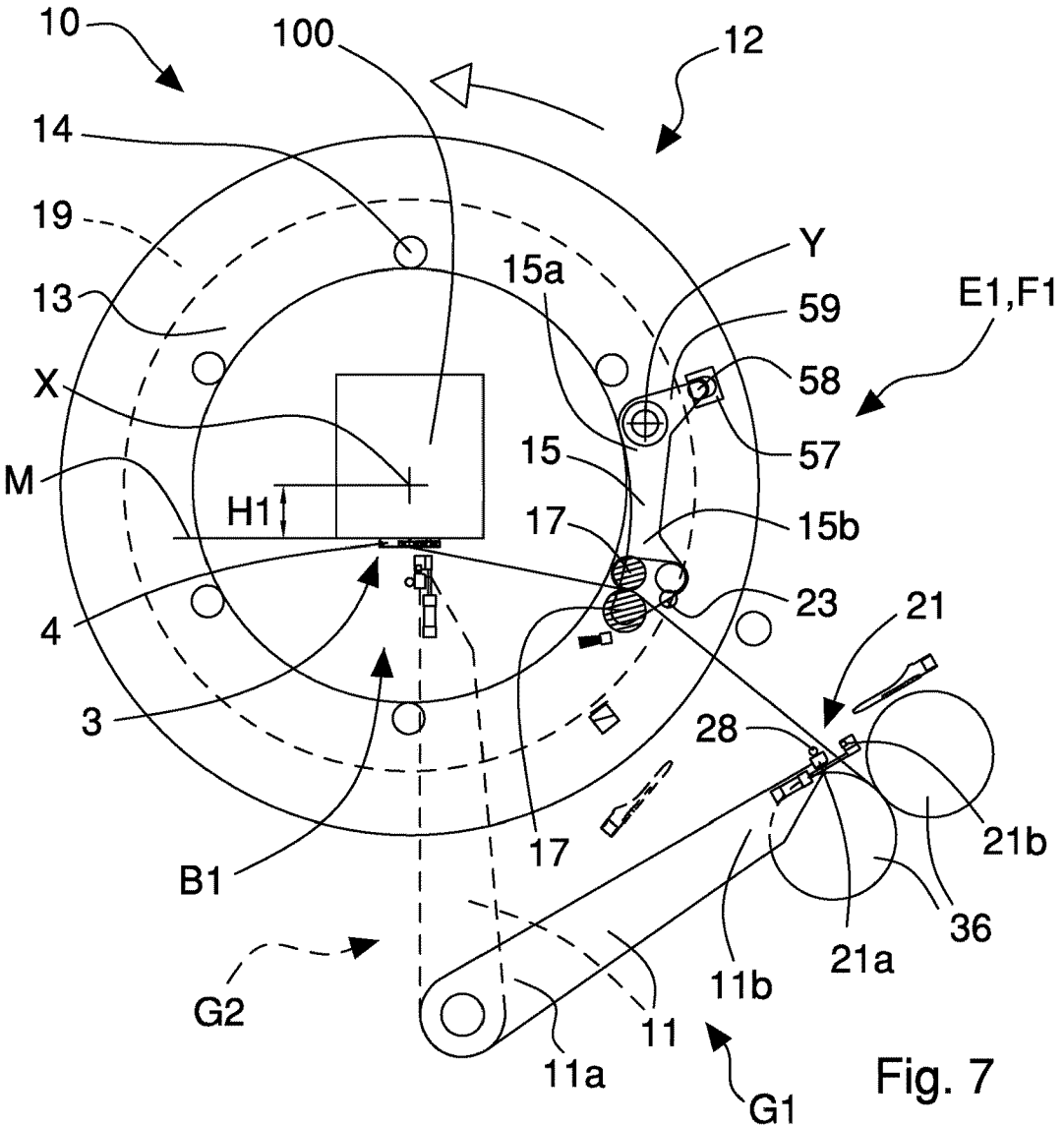
FIG. 7 is a schematic side view of the wrapping means and of an insertion arm of the wrapping machine of FIG. 1 in an operating step.
Figure 10:
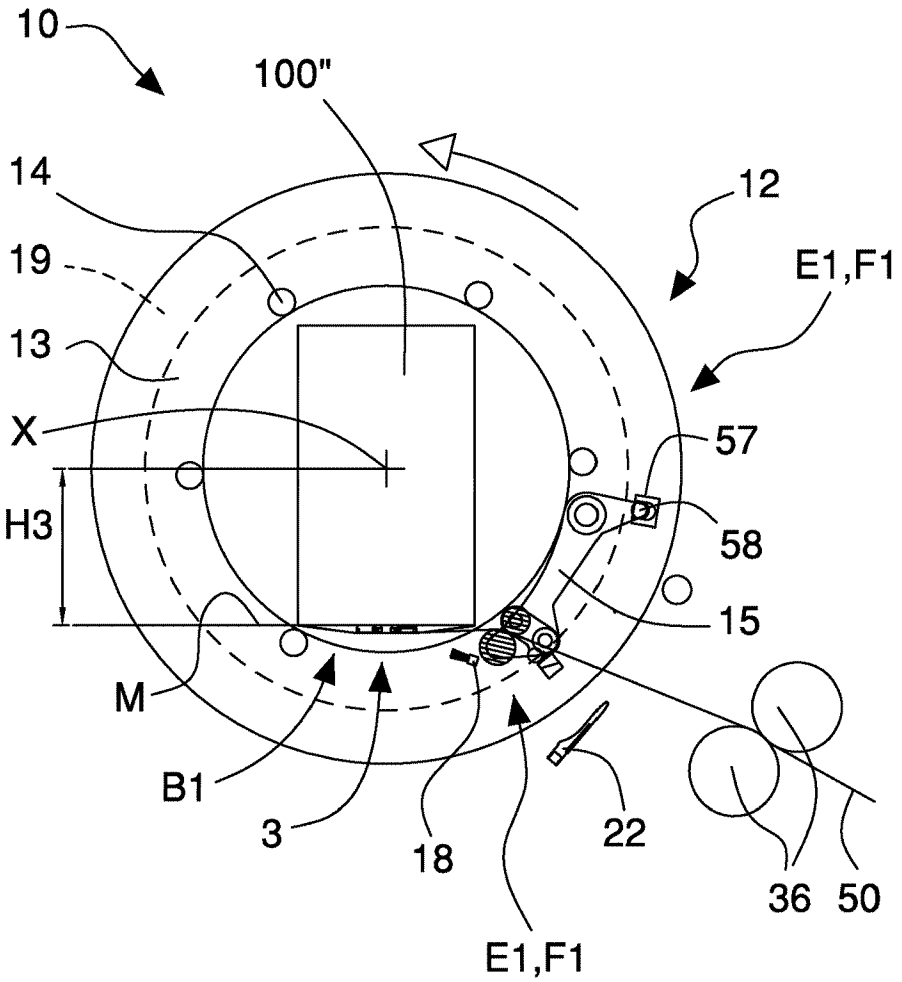
FIGS. 9 and 10 are schematic side views of the wrapping unit of the wrapping machine of FIG. 1 in two respective different working positions with respective different loads to be wrapped.
Figure 9:
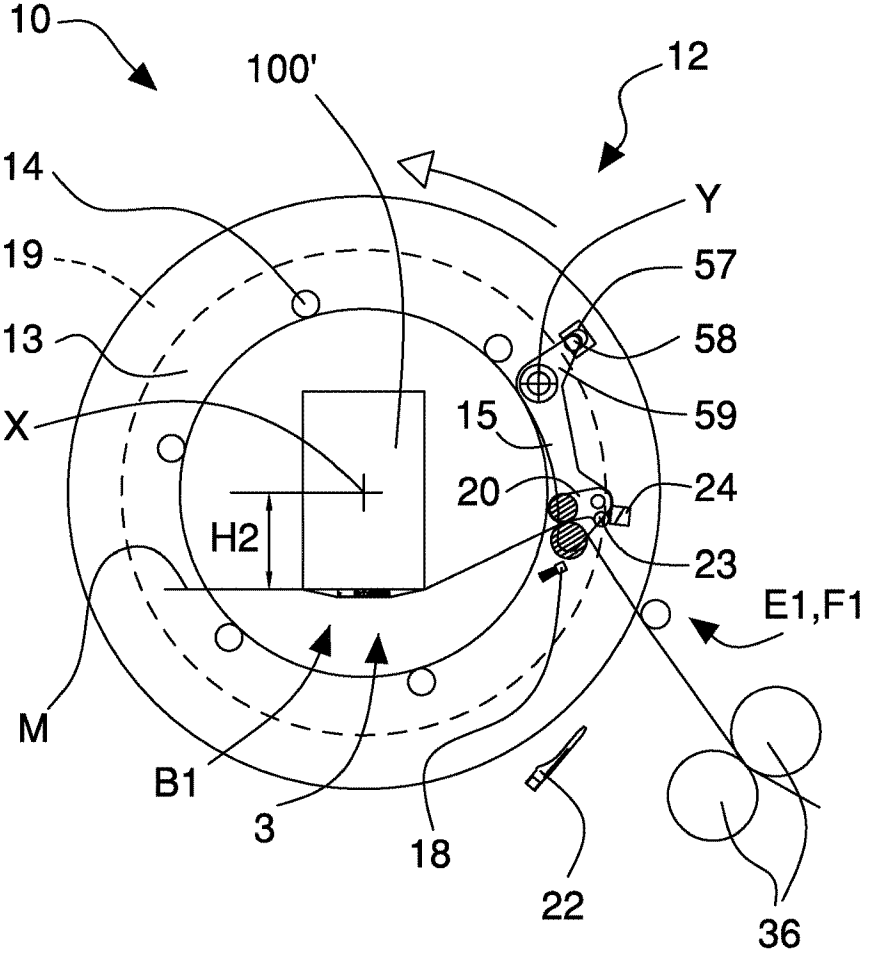
Figure 13:
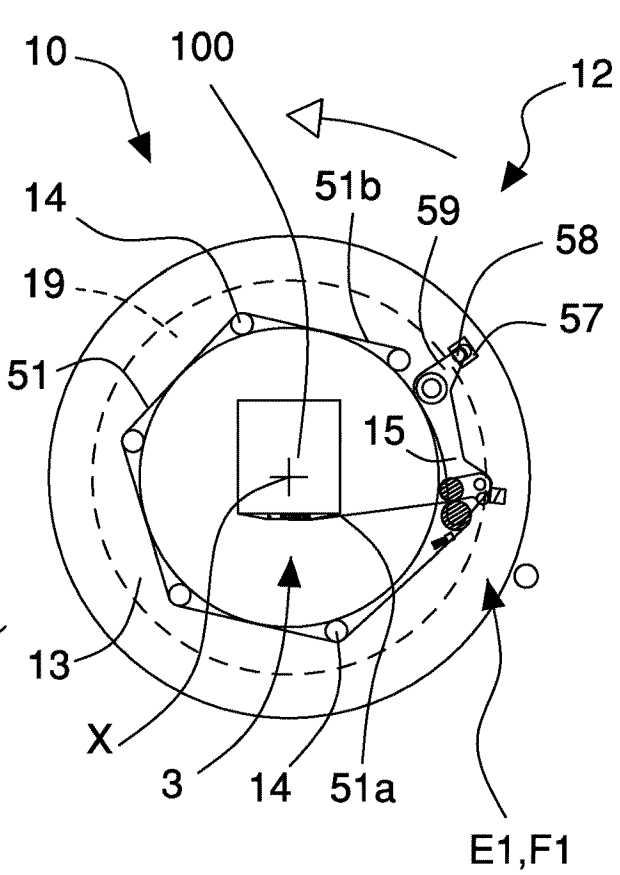
FIGS. 11 to 17 are schematic and partial side views of the wrapping unit with a load to be wrapped in respective wrapping steps.
Figure 12:
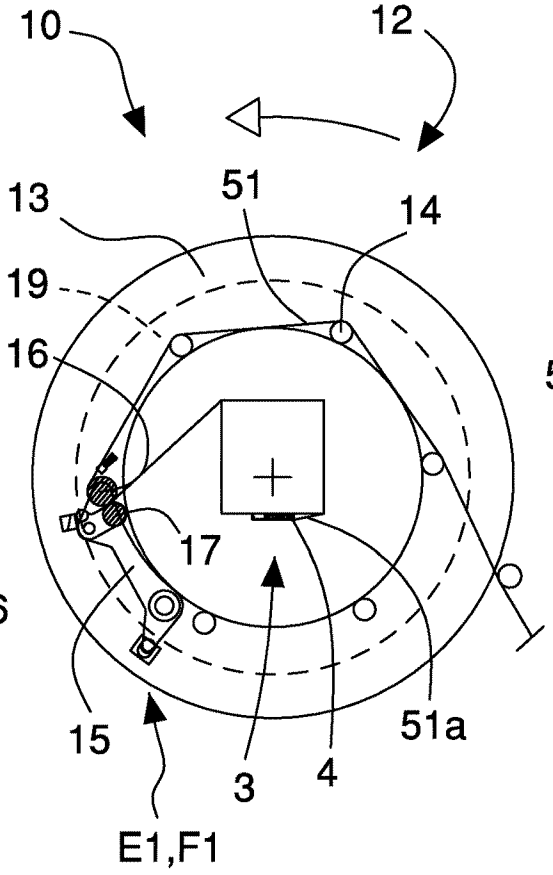
Figure 11:
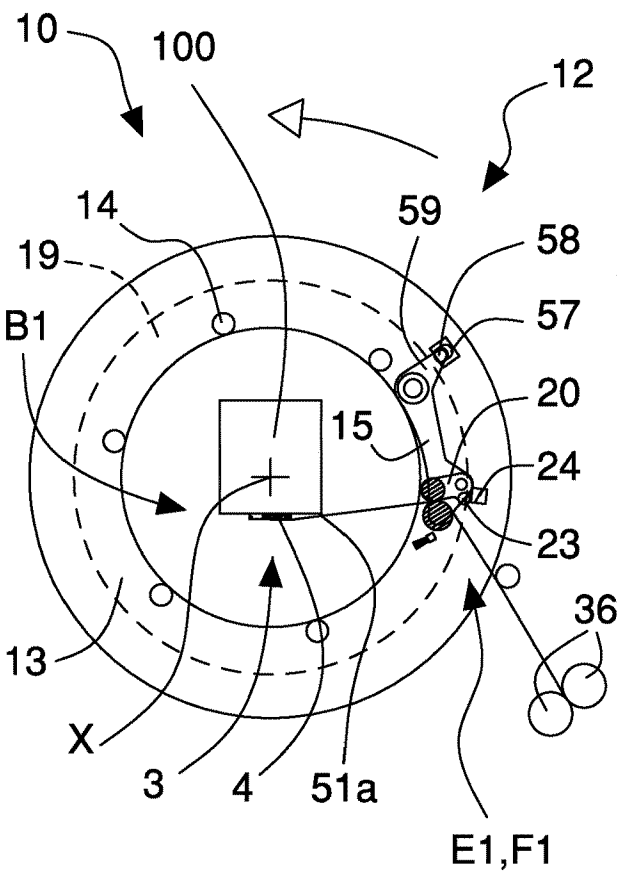
Figure 16:
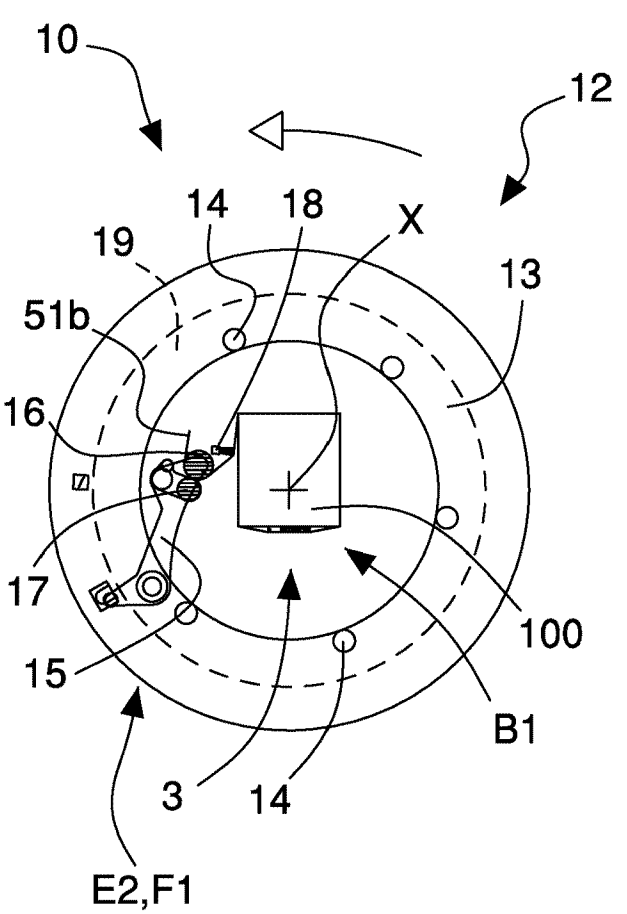
Figure 15:
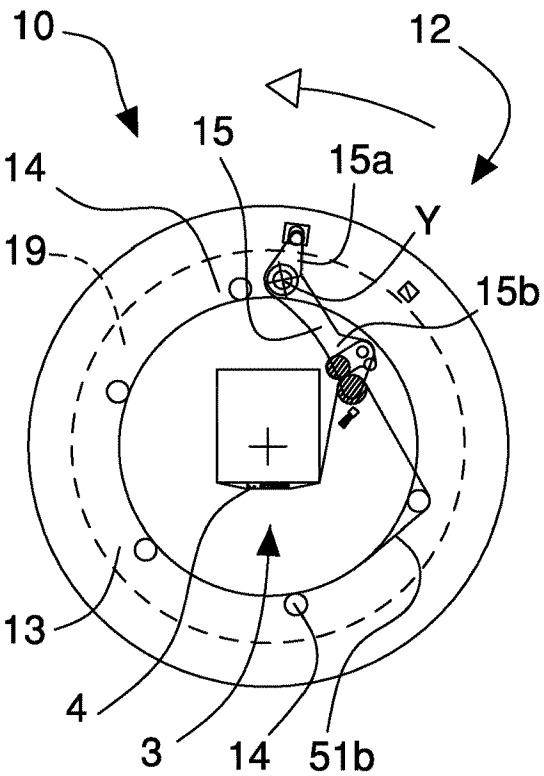
Figure 14:
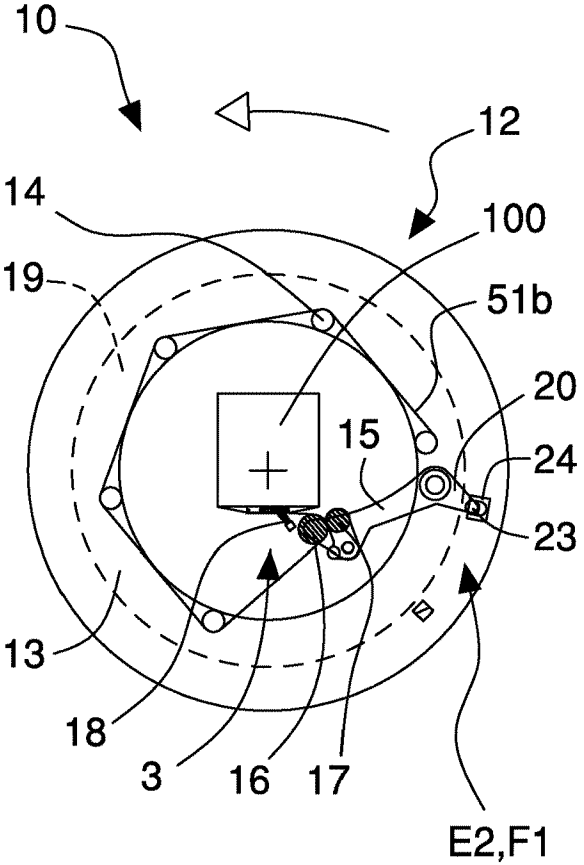

FIGS. 7, 9 and 10 show respective examples of the wrapping machine 1 of the invention associated with loads having different dimensions, for example pallets supporting groups of products. In case of loads or products or pallets 100 having a small size (FIG. 7) the wrapping means 12 are positioned in such a way that the rotational axis X is at a first distance H1 from the supporting plane M which is smaller than a second distance H2 of positioning of the rotational axis X with loads or products or pallets 100' having an intermediate size (FIG. 9). In turn, the second distance H2 is smaller than a third distance H3 of positioning of the wrapping axis X of the wrapping means 12 with big size loads, products or pallets 100''' (FIG. 10).

The unwinding arm 15 is movable between a first operative position E1, in which the unwinding rollers 16, 17 are more spaced from the load 100 for deflecting the material portion 51 towards the load, in particular in the first wrapping step, and a second operative position E2, in which the unwinding rollers 16, 17 are closer to the load 100 for deflecting toward the load at least the terminal flap 51*b* of the material portion 51. For this purpose, the unwinding arm 15 comprises brush means 18 fixed to the second end 15*b* and arranged for abutting and sticking the material portion 51, in particular the terminal flap 51*b*, to the load 100 at the end of the wrapping.

The wrapping means 12 further include a driving ring 19 adjacent and coaxial to the supporting ring 13 and rotatably drivable around the wrapping axis X separately and independently from the supporting ring 13. The driving ring 19 is rotatably supported by frame means 9 of the machine and is rotated by respective actuating means comprising, for example, a rotating electric motor. The driving ring 19 is connected to the first end 15*a* of the unwinding arm 15 so as to rotate the latter at least between the first operative position E1 and the second operative position E2. More precisely, the driving ring 19 has a seat 57 arranged to receive a first guiding pin 58 fixed to a moving portion 59 of the unwinding arm 15 that extends from the second end 15*b*. Alternatively, the driving ring 19 can comprise a cam profile suitable to abut and move the guiding pin 58.

As better explained in the following of the description, the relative rotation of the driving ring 19 with respect to the supporting ring 13 causes the rotation of the unwinding arm 15 around the respective rotational axis Y between the first operative position E1 and the second operative position E2.

The first unwinding roller 16 is rotatably mounted around a respective rotating axis on the second end 15*b* of the unwinding arm 15. The second unwinding roller 17, rotatably mounted around a respective rotating axis on the second end 15*b* of the unwinding arm 15 is also movable between an abutting position F1, wherein it abuts the first unwinding roller 16 in order to engage and draw the material portion 51, and a disengagement position F2, wherein the second unwinding roller 17 is spaced away from the first unwinding roller 16 to allow, in the initial setting step, the insertion arm 11 transferring the initial flap 51*a* to the gripping means 4 and the first roller 16 being abutted by the material portion 51. In particular, the unwinding arm 15 is provided with a driving lever 20 rotatably fixed to the second end 15*b* of said unwinding arm 15 and rotatably supporting the second unwinding roller 17.

The driving lever 20 is moved by the driving ring 19 so as to move the second unwinding roller 17 between the abutting position F1 and the disengagement position F2. More precisely, the driving lever 20 has a second guiding pin 23 that is abutted (in the first operative position E1 of the unwinding arm 15) by a driving element 24 of the driving ring 19. The driving element 24 has an abutting wall that is against the second guiding pin 23; in that way, a relative rotation of the driving ring 19 with respect to the supporting ring 13 makes the second guiding pin 23 sliding on the abutting wall and thus the partial rotation of the driving lever 20.

The insertion arm 11 comprises a first terminal portion 11*a* rotatably fixed to the frame means 9 of the machine 1 and a second terminal portion 11*b* provided with second gripping means 21 suitable to grab and hold the initial flap 51*a* of the material portion 51. The insertion arm 11 is rotatably drivable between a gripping position G1, in which said insertion arm is adjacent to said supplying unit 30, in particular to grab the initial flap 51*a*, and a transferring position G2, wherein the second gripping means 21 of the insertion arm 11 are adjacent and facing the first gripping means 4 of the supporting means 3 in order to transfer the initial flap 51*a* thereto. For this purpose, the transferring arm 11 comprises an insertion bar 28 positioned at the second gripping means 21 and movable along the insertion arm 11 itself in order to insert the initial flap 51*a* between the two supporting elements 4 positioned in the opening position B2. The initial flap 51*a* is maintained by an air blow emitted from the insertion bar 28 inside the supporting elements 4 until the latter are moved in the closing position B1.

The insertion bar 28 is linearly moved by a respective linear actuator, for example a pneumatic cylinder, of known type and not shown in the figures.

In the embodiment shown in the figures, second gripping means include pliers 21 provided with a fixed member 21*a* and a movable member 21*b*, the latter moved by a respective linear actuator 29, for example a pneumatic cylinder, between a position abutting the fixed member 21*a* to grab and block the initial flap 51*a* of the portion 51 and a position spaced from the said fixed member 21*a* to allow the release of the initial flap 51*a* and/or the passage of the material 50.

First blowing means 22 fixed to the frame means 9 of the wrapping machine 1 are provided in order to emit a compressed air jet capable to move away the flexible and wrappable material 50 from the pliers 21 during the return movement of the insertion arm 11 from the transferring position G2 to the gripping position G1.

With particular reference to FIG. 3, the supplying unit 30 comprises supporting and moving means 31, 31' to support and rotate at least one reel 55 of flexible and wrappable material 50, for example an extensible plastic film, unwinding means 32 to unwind and pre-stretch said material 50 unwound from the reel 55 and cutting means 80 to execute a separation line on said material 50 transversal to an unwinding direction of the material and arranged to separate the material portion 51, coming out from the unwinding means 32, from the material 50 unwound from reel 55.

The unwinding means 32 comprise, in particular in the shown embodiment, a couple of pre-stretching rollers 33, 34, motorized and suitable to unwind and pre-stretch the material 50, first return rollers 35 in order to deflect the material 50 towards the pre-stretching rollers 33, 34 and a couple of pulling rollers 36 motorized and arranged to dispense the material portion 51 to the wrapping unit 10 and to keep under tension the film tract between the pulling rollers and the pre-stretching rollers 33, 34.

The pre-stretching rollers comprise a first fast roller 33 positioned downstream of a second slow roller 34 in such a way to stretch or elongate the flexible and wrappable material 50 by a preset percentage (according to the rotation speed difference between the two rollers).

The pre-stretching rollers 33, 34 are rotated by at least one motor. Second return rollers 37 are provided upstream of the pre-stretching rollers and form dancing means for controlling tension and supply of material 50 during the wrapping. Alternatively, the material tension can be adjusted and controlled by means of load cells associated to the return rollers or by measuring the operative parameters of the motors that drive the pre-stretching rollers 33, 34 and the pulling rollers 36.

The cutting means 80 are arranged between the two pulling rollers 36 and a return roller 35, downstream of the pre-stretching rollers 33, 34 to execute a plurality of cuts on the material 50, in particular a plurality of perforations forming a separation line.

For this purpose, the cutting means 80 comprise a cutting roller 81 rotating around a respective longitudinal axis and provided with a plurality of cutting elements mutually spaced along said longitudinal axis and arranged to cut and perforate the material 50 so as to make the transversal separation line, in particular orthogonal to an unwinding direction of the material 50. The cutting means 80 also comprise a rotatable counter roller 82, provided with a longitudinal cavity arranged to receive the cutting elements of the cutting roller. The counter roller 82 rotates synchronous with the cutting roller 81, both rollers being rotated by the same motor.

Sensor means are provided to measure the length of the portion 51 dispensed by the supplying unit 3. Such sensor means comprise, for example, an angular transducer or encoder that measures the number of turns of the pulling rollers 36.

As better explained in the following of the description, during the wrapping of the load 100, when the material portion 51 is completely exited from the supplying unit 30, in particular when the separation line has passed the pulling rollers 36, the latter ones and the pre-stretching rollers 33, 34 are stopped and the second gripping means 21 of the insertion arm 11 are closed in order to block the material 50. In such a way, the material portion 51 drawn by the wrapping means 12, in particular by the rotation of the supporting ring 13, is separated along the separation line from the flexible and wrappable material 50 coming from the reel 55. Because of the traction, which the material 50 undergoes to, the plastic material weakened by the cuts made by the cutting means 80 is torn in a precise and clean way along a transversal line.

The flap of material 50 held by the pliers 21 forms the initial flap 51*a* of the subsequent portion 51 intended to wrap a respective load 100.

Second blowing means 38 are provided downstream of the two pulling rollers 36 to blow the material flap generated from the breaking and held by the second gripping means 21 towards the insertion arm 11 over the insertion bar 28.

In the shown embodiment, the supporting and moving means 31, 31' include first supporting and moving means 31 and second supporting and moving means 31' that are arranged to support and rotate respective reels 55 of film 50 and joining means 85, of a known type and not shown in details, for joining a head flap of a new reel 55 to a tail flap of an almost depleted reel 55. In this way, the substitution of the reels 55 can occur without requiring stopping the wrapping machine 1.

Figure 1:
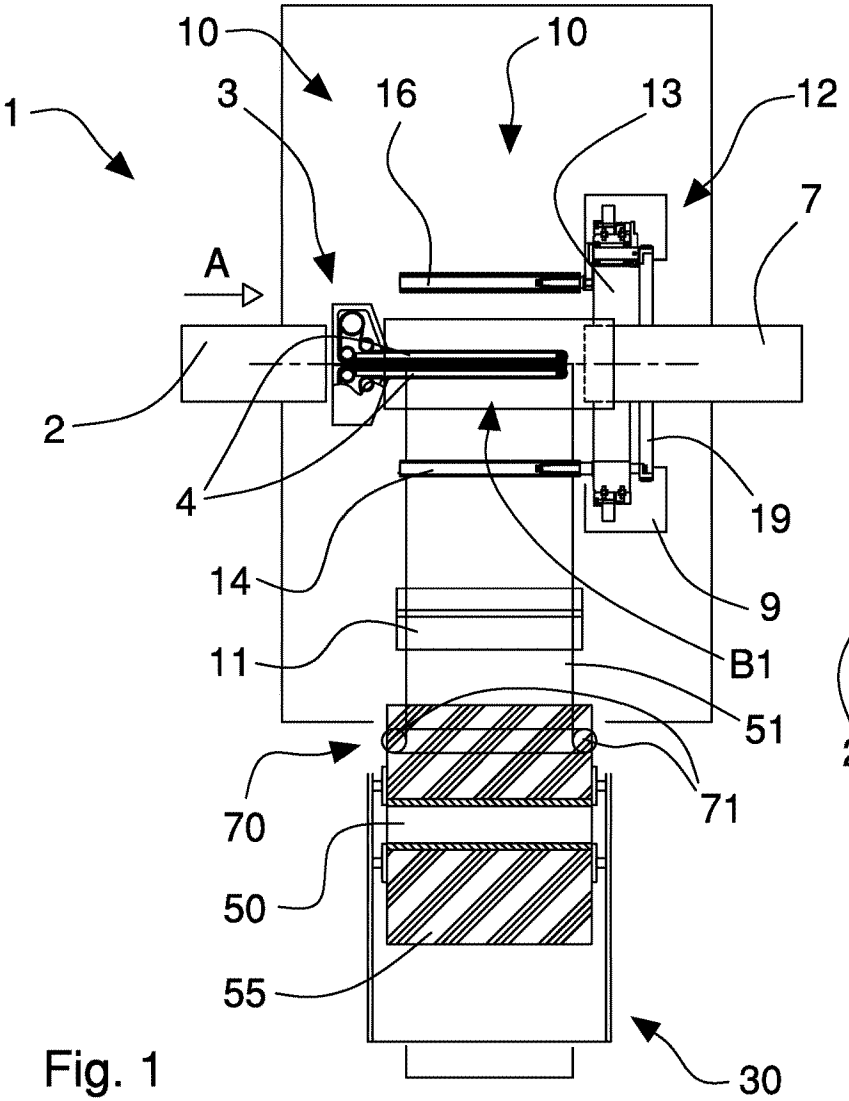
FIG. 1 is a schematic top plan view of the wrapping machine of the invention associated with a load to be wrapped.

With particular reference to FIG. 1, the wrapping machine 1 of the invention can also include narrowing means 70 of the portion 51 of flexible and wrappable material coming out from the supplying unit 30, in particular in the case said material comprises an extensible plastic film. The narrowing means 70 comprise a couple of narrowing rollers 71 that are mounted parallel and opposed to each other, free to rotate around respective longitudinal axes, substantially orthogonal to the portion 51 of film. The narrowing rollers 71 abut and fold, in particular partially roll up, longitudinal opposed edges of the material portion, in order to confer a greater mechanical resistance to the material portion and to the wrapping made around the load.

The transversal distance between the two narrowing rollers 71 can be adjusted by suitable actuating means according to the width of the flexible and wrappable material or film 50 and/or the extent of the rolling up/folding to be executed on the longitudinal edges of the portion 51.

In a variant of the wrapping machine 1 of the invention not shown, the wrapping unit 10 can be arranged for wrapping the load 100 with a flexible and wrappable material consisting of a tape or band or strip of a not extensible plastic film so as to form one or more rings or wrapping around the load and blocked in position by means of welding and/or gluing. The wrapping rollers and the gripping rollers of the wrapping means have an extension or length substantially equal to the width of the tape.

In this case, the wrapping unit is without the pre-stretching rollers that are not needed for extending the tape or strip.

The operation of the wrapping machine 1 of the invention provides, for example, advancing along first conveyor means 2 the load 100 to be wrapped with the material 50. Close to the wrapping unit 10, the load 100 is transferred from the first conveyor means 2 to the supporting means 3 (by known and not shown means); in particular, the load 100 is transferred on the supporting plane M formed by the supporting walls 41 of the supporting elements 4. The latter ones, which act as first gripping means, are positioned in the closing position B1 because they hold and block the initial flap 51*a* of the material portion 51 to be wrapped around the load 100.

Once the group 100 of products is at least partially arrived inside the wrapping unit 10 in the right wrapping position, the wrapping means 12 can be started to begin the wrapping with the film.

The position of the wrapping means 12 with respect to the supporting plane M is preventively adjusted according to the dimensions of load 100. In particular, the supporting ring 13 and the driving ring 19 are vertically moved, orthogonally with respect to the supporting plane M.

The wrapping procedure (shown in FIGS. 11 to 17 for a load 100' or a group of products having a small size, for example a plurality of aligned cans) provides a first step in which the supporting ring 13, by rotating around the wrapping axis X, unwinds and draws the portion 51 of material or film 50 from the supplying unit 30 and wraps a first tract of said material portion 51 provided with the initial flap 51*a* (blocked by the first gripping means 4) around the load 100 and a second tract of said material portion 51, provided with the terminal flap 51*b*, around the wrapping rollers 14 (FIGS. 12 and 13) The unwinding arm 15 is positioned in the first operative position E1 so as to deflect the portion 51 towards the load or group 100' of products. For this purpose, the driving ring 19 rotates together with and at the same speed of the supporting ring 13.

The portion 51 is wrapped around the load 100' and around the supporting elements 4, in particular abutting the support elements 4 (in particular the first belts 42) along the operative tract T.

Figure 17:
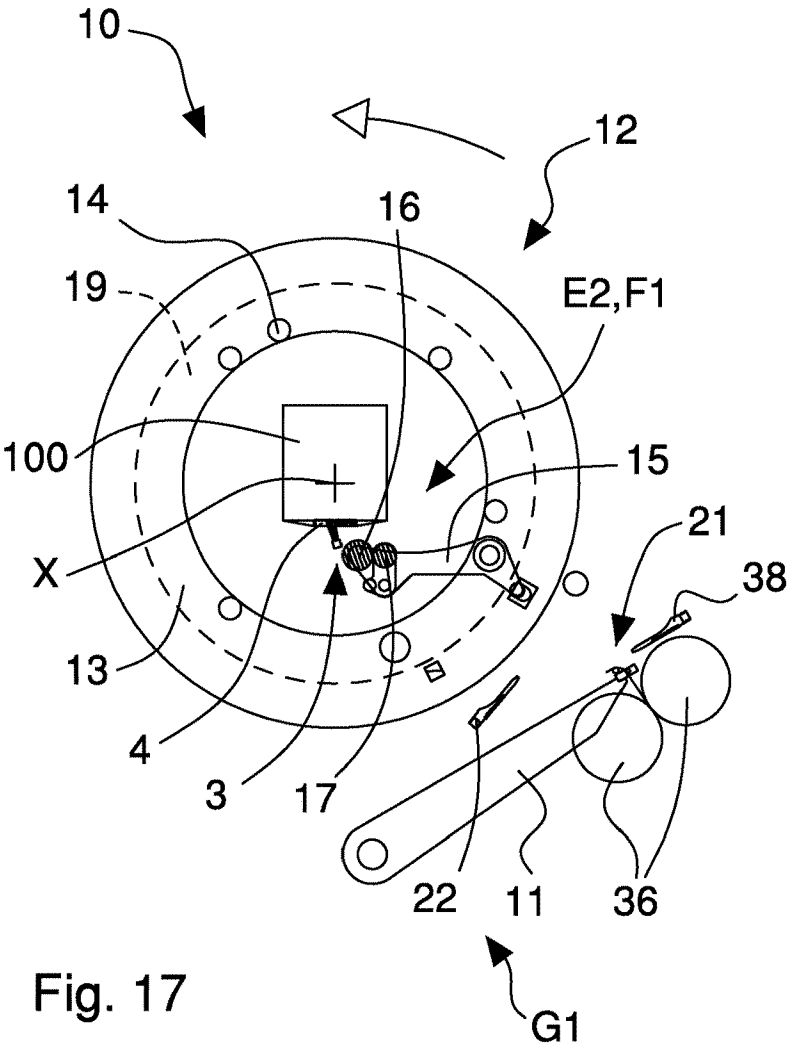

Then, the material portion 51 is detached from the material 50 connected to the reel 55 thanks to the separation line realized by the cutting means 80. More precisely, while the material portion 51 is wrapped around the wrapping rollers 14, thanks to the rotation of the supporting ring 13, the material 50 is held by second gripping means 21 of the insertion arm 11, the pulling rollers 36 blocked. In such a way, the flexible and wrappable material 50 is put under traction and is torn along the separation line in a clear way, allowing the separation of the material portion 51 that can be completely wrapped around the load 100' (FIG. 17).

In a second wrapping step, the supporting ring 13, by rotating around the wrapping axis X, wraps the second tract of the material portion 51, drawn and unwound from the wrapping rollers 14, around the load 100'. In this second wrapping step, the unwinding arm 15 is moved in the operative position E2 wherein brush means 18 abut and push the material portion 51, in particular the terminal flap 51*b*, to stick on the load 100 (FIGS. 14-17). The unwinding arm 15 is moved in the second operative position E2 thanks to the relative rotation of the driving ring 19 with respect to the supporting ring 13.

It should be noticed that the length of the material portion 51 is selected in such a way that the terminal flap 51*b* is applied at the base of the load 100', i.e. substantially superimposed to the initial flap 51*a*. The correct and desired length of the material portion 51 is verified by the sensor means of the supplying unit 30, which detect the unwinding of the material portion, for example exiting the pulling rollers 36.

The load 100' is wrapped with a plurality of turns of the flexible and wrappable material. The load 100 can be held motionless on the supporting means 3, for example having a length shorter than or substantially equal to the width of the material 50, or it can be wrapped while moves along the advancing direction A, for example having a length longer than the width of the material 50.

In the example shown in the figures, the flexible and wrappable material 50 is an extensible plastic film and the different turns stick to each other and to the load 100 thanks to the adhesiveness of the film, which is preferably made of a plastic material containing a suitable adhesive. The film adhesiveness guarantees that the terminal flap 51*b* remains attached to the load 100 at the end of the wrapping. The brush means 18 allow the film sticking to the load 100 in an optimal way.

Alternatively, the terminal flap 51*a* can be fixed to the load 100 by means of gluing or welding by suitable known means.

The compactness of the wrapping is guaranteed also by the resilient return of the plastic film 50 subjected to a pre-stretching or extension when exiting the supplying unit 30 by means of the pre-stretching rollers 33, 34. In fact, once placed and wrapped around the load 100, the material or film 50 tends to shrink and return to the original length in that way stabilizing and compacting the load.

It should be noted that, since the length of the material portion 51 is preset, defined according to dimensions and/or shape of the load 100 and since the initial flap 51*a* and terminal flap 51*b* can be positioned in defined and repeatable positions with respect to the load 100 (at its base), it is possible to use for the wrapping a flexible and wrappable material 50, for example a film made of extensible plastic material, having printings, writings, drawings, decorations or the like which in the wrapped load 100 will be placed in the desired positions, for example on the sidewalls or the top or the base.

Once finished the wrapping of the load 100, the latter is transferred on the second conveyor means 7. For this purpose, the first moving belts 42 of the supporting elements 4 are rotated to allow the load 100 disengaging therefrom. In particular, the first belts 42 are driven in such a way to move at the operative tract T along the advancing direction A together with the load 100, this allowing the progressive disengagement of the material being wrapped on said second belts 42.

The second conveyor means 7 convey the load 100 out of the wrapping machine 1 along the advancing direction A.

At the end of the wrapping and before the transfer of the load 100 from the supporting means 3 to the second conveyor means 7, the supporting elements 4 are moved in the opening position B2 to allow the release of the initial flap 51*a* and therefore of the wrapped load 100 and the following insertion of the initial flap 51*a* of a subsequent material portion 51 dispensed from the supplying unit 30 to wrap the next load 100.

Therefore, before the wrapping an initial setting step of wrapping is provided in which the wrapping arm 15 is brought back in the first operative position E1 and the second unwinding roller 17 is moved in the disengagement position F2, i.e. spaced away from the first unwinding roller 16 to allow the passage of second gripping means 21 of insertion arm 11.

Figure 8:
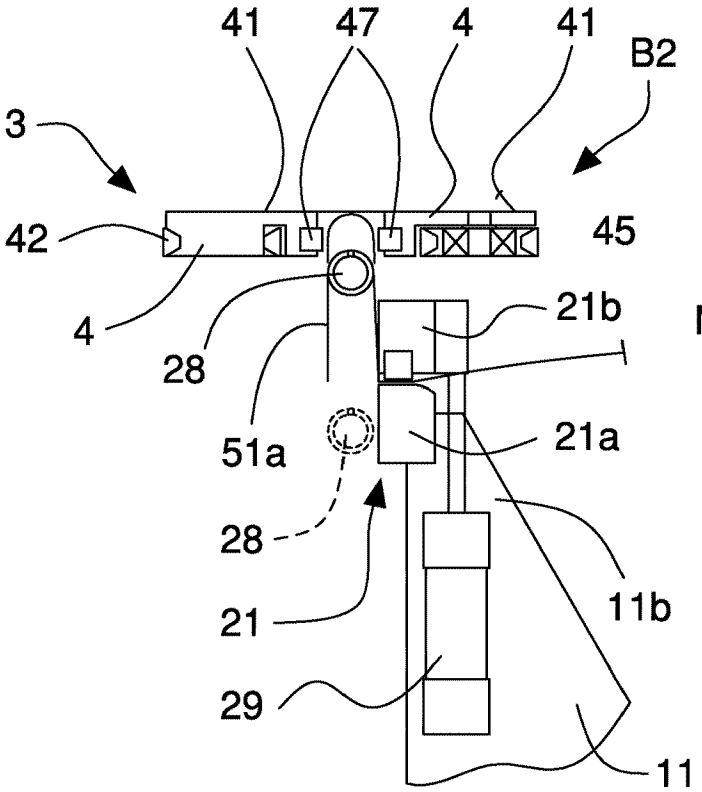
FIG. 8 is a partial and enlarged side view of the supporting means and the insertion arm in another operating step.
Figure 18:
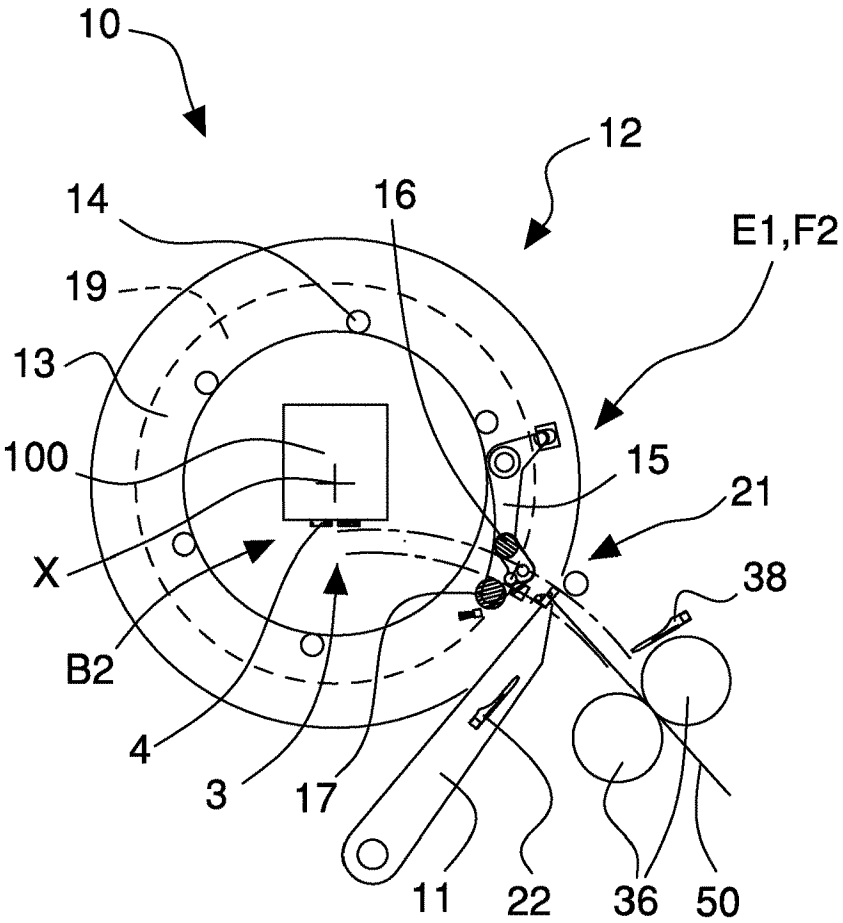
FIGS. 18 to 20 are schematic and partial side views of the wrapping unit in a wrapping setting step.
Figure 19:
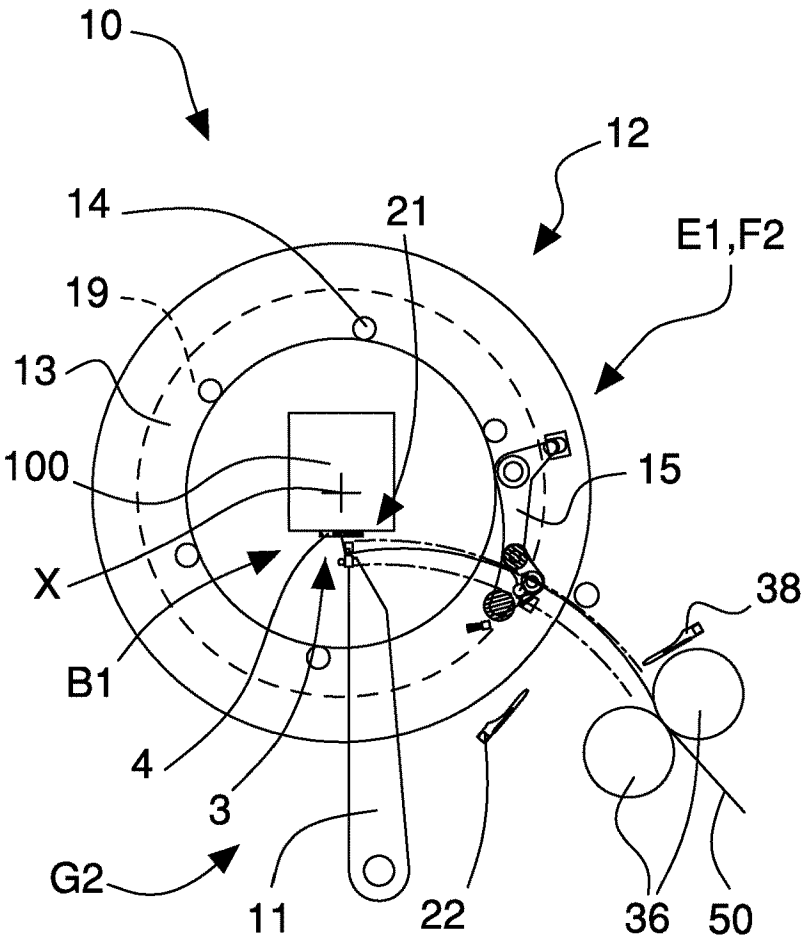
Figure 20:
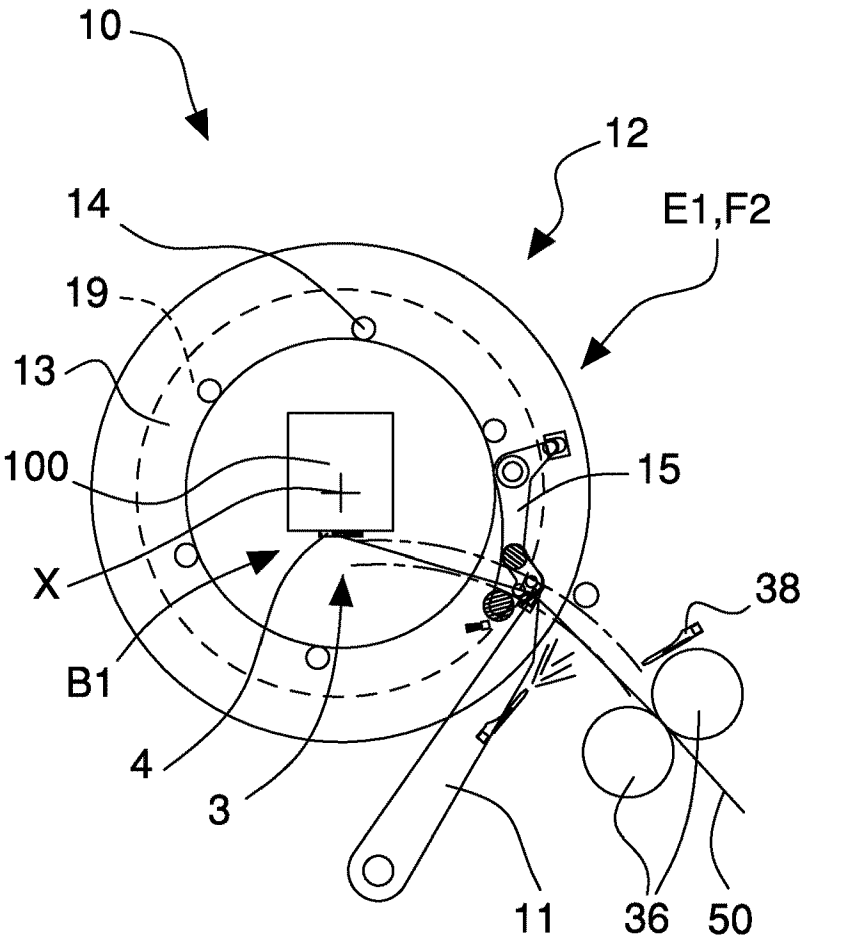

In fact, the second gripping means 21 are closed to hold the initial flap 51*a* of a subsequent portion 51 to be unwound and separated from the material 50. Then, the insertion arm 11 is moved from the gripping position G1 to the transferring position G2 in which it is adjacent to the supporting means 3 in order to transfer the initial flap 51*a* to the first gripping means 4 thereof (FIGS. 18-20). More precisely, in the transferring position G2 of the insertion arm 11, the second gripping means 21 are facing the first gripping means 4, i.e. the supporting elements 4 spaced apart from each other in the opening position B2 to allow inserting the initial flap 51*a* therebetween. The initial flap, being folded by the second blowing means 38 on the insertion bar 28 of the insertion arm 11, after the breaking of the material 50 and the separation of the previous portion 51, is pushed between the two supporting elements 4 by the insertion bar 28, which is moved in approach to the supporting means 3, and by a compressed air jet dispensed by the insertion bar 28 (FIG. 8). While the air jet is dispensed, the two supporting elements 4 are moved in the closing position B1 in order to block and hold the initial flap 51*a*. At the same time, the insertion bar 28 is brought back in a respective retracted position wherein it is more distant from the supporting means 3.

Then, the insertion arm 11 is brought back in the gripping position G1, with the second gripping means 21 in the opening position to allow the passage of the material 50 during the wrapping. At the same time, the second unwinding roller 17 is moved in the abutting position F1 in order to engage the material portion 51 together with the first unwinding roller 16.

The wrapping means 12 can be activated for performing the wrapping of the material portion 51 around the load 100 as described above.

It should be noted that during the operation of the wrapping machine 1 of the invention, an almost depleted reel of flexible and wrappable material could be easily replaced with a new reel of flexible and wrappable material without the need to stop the operation thanks to the joining means 85 of the supplying unit 30. In fact, the joining means 85 allow joining the head flap of the new reel to the tail flap of the almost depleted reel 55. The depleted reel can be removed from the supplying unit 30 and replaced with a new reel during the operation of the wrapping machine, which uses the other reel.

Therefore, the wrapping machine 1 of the invention has a high productive autonomy, since it is not bound to the substitution of the material reels 55.

By placing the material reel 55 on the side of the machine, inside the supplying unit 30, there is also a remarkable reduction of the rotating masses of the wrapping means 12 (supporting ring 13 and driving ring 19) with respect to the known wrapping apparatuses provided with a rotating supporting ring, this allowing to increase the performances of the wrapping machine (rotational speed, acceleration) and/or to reduce the energy consumption of the motors used for rotating the rings. The smaller masses rotated by the rings also allow to reduce the structural stresses of the wrapping unit extending its operating life and diminishing the damaging risks.

Thanks to the wrapping machine 1 of the invention it is therefore possible to effectively and efficiently wrap a load 100 using a flexible and wrappable plastic material 50, for example a film made of extensible plastic material.

Moreover, the wrapping machine allows wrapping a load, including a product or a group 100 of product to be packaged in a bundle, using a flexible and wrappable material 50, typically a plastic film, which is printed, i.e. provided with writings, drawings, decorations or the like. In fact, the portion 51 having a predetermined length can be positioned in a precise and reproducible way around the load 100, this allowing placing writings, drawings, decorations or the same in the desired positions on the load 100.

The wrapping machine 1 of the invention is also versatile and flexible since allows wrapping a load formed by a product or group of products having different sizes and dimensions in a precise and efficient way, without requiring complicated and difficult adjustment and/or setting operations. In fact, it is sufficient to modify the position of the wrapping means 12 (i.e. the support ring 13 and drive ring 19) with respect to the supporting plane M in order to arrange the load 100 to be wrapped in the optimal wrapping position.

Figure 21:
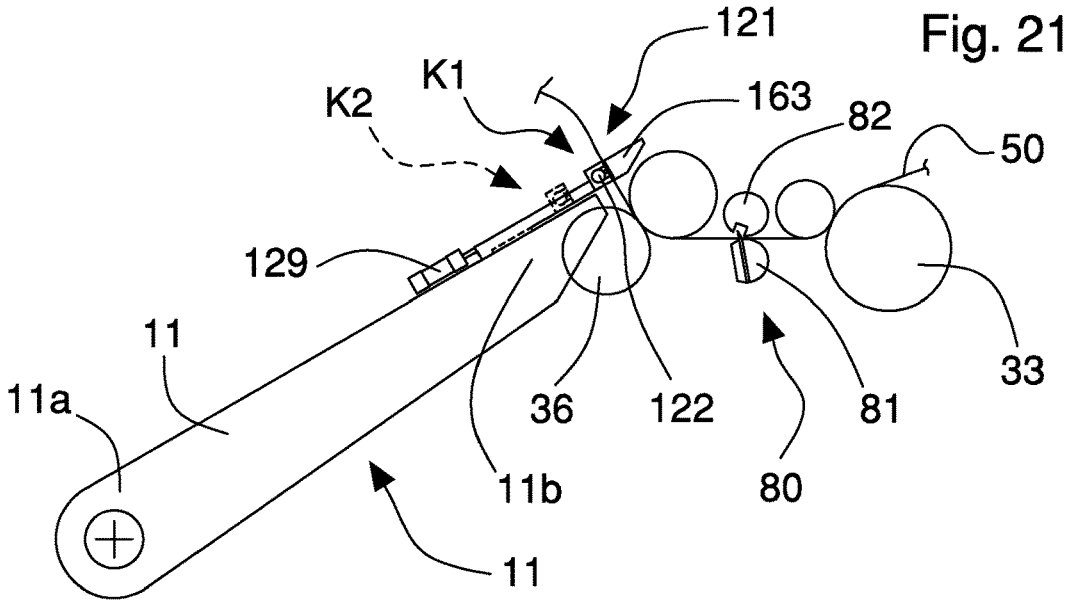
FIG. 21 is a partial side view of an insertion arm of a variant of the wrapping machine of the invention during an operative step.

FIG. 21 shows a variant of the wrapping machine 1 of the invention, which differs from the above-described embodiment in the insertion arm 11 that is provided with second gripping means 121 comprising a gripping bar 122 having a shape that is elongated and transversal to the material 50 and provided with air suction means suitable to hold by depression or suction the initial flap 51*a* of the material portion 51. The gripping bar 122, for example, has a quadrangular cross-section and has an abutting wall for the material on which a plurality of openings of the suction means are made that are in flow connection with a suction unit, for example a vacuum pump, of the wrapping machine 1. The gripping bar 122 is movably mounted on the insertion arm 121 and is linearly driven along a direction almost orthogonal to the material, between an extended position K1 and a retracted position K2, by a respective linear actuator 129, for example a pneumatic cylinder.

With the insertion arm 11 in the gripping position G1, the gripping bar 122 is moved in the extended position K1 to abut and therefore hold the material 50. For this purpose, the gripping bar 122 pushes the material 50 against a fixed elongated counter element 163 of the supplying unit 30. In the retracted position K2, the gripping bar 122 allows the free movement of the material 50 and allows the insertion arm 11 rotating between the gripping position G1 and the transferring position G2.

With the insertion arm 11 in the transferring position G2, the gripping bar 122 is moved in the extended position K1 in order to transfer the initial flap 51*a* to the first gripping means 4 of the supporting means 3. For this purpose, the air suction through the openings of the gripping bar 122 is stopped and through the latter compressed air is emitted, which pushes said initial flap 51*a* against the first gripping means 4, more specifically inside the cavity or slot formed by the two supporting elements 4 being positioned in the opening position B2. Once grabbed the initial flap 51*a*, by moving the supporting elements 4 in the closing position B1, the gripping bar 122 can be brought back in the retracted position K2 in order to allow the insertion arm 11 rotating in the gripping position G1.

Figure 22:
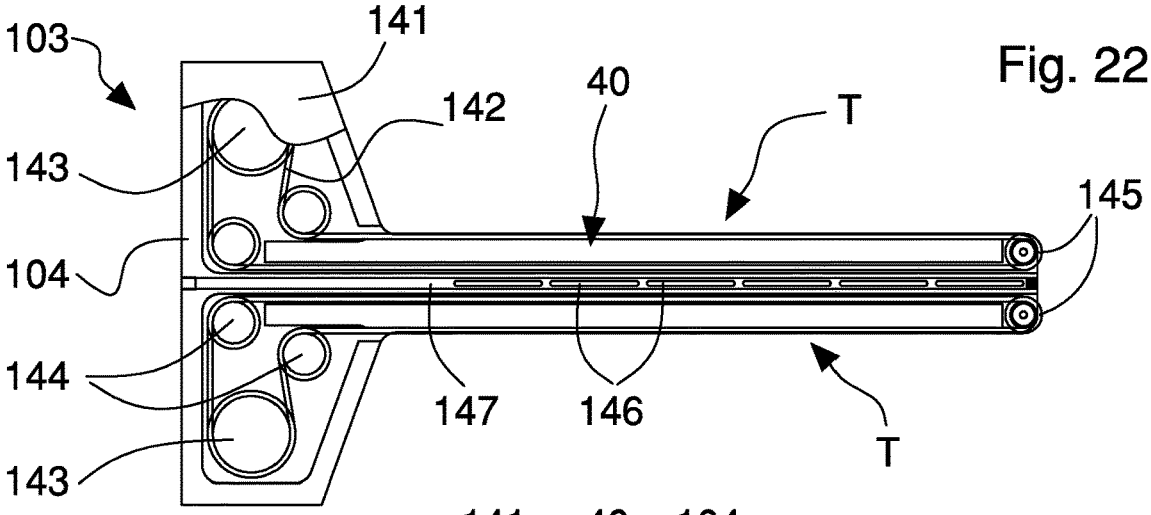
FIG. 22 is a partial top view of another variant of the wrapping machine of the invention showing the supporting means of the load.
Figure 23:
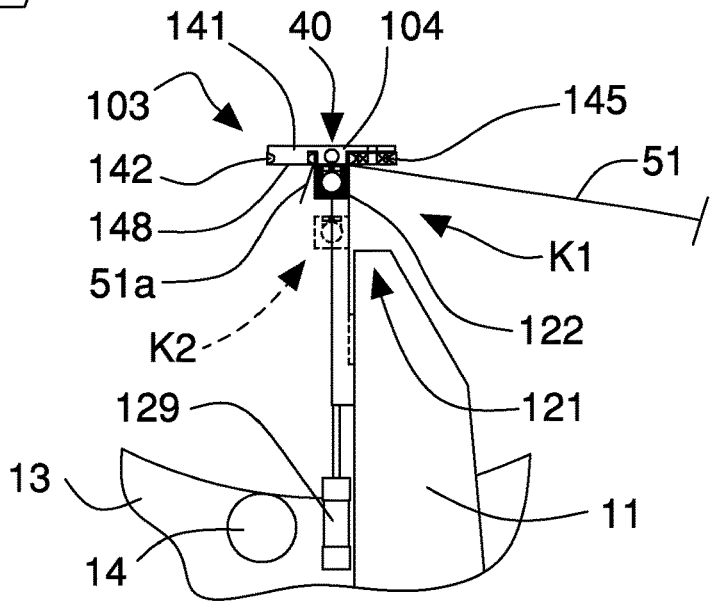
FIG. 23 is a schematic and partial side view of the supporting means of FIG. 22 and of the insertion arm in an operative step.

FIGS. 22 and 23 show another variant of the wrapping machine 1 of the invention that differs from the embodiment of FIGS. 1 to 20 in the insertion arm 11, the supporting means 103 and the related first gripping means 104.

The insertion arm 11 is the one provided with second gripping means 121 with suction means above described and shown in FIG. 22.

The supporting means 103 include first gripping means formed by a single supporting element 104 having a substantially elongated shape in the advancing direction A and comprising a supporting wall 141, which forms the supporting plane M for the load 100, and air suction means 40, arranged to suck and hold by depression the initial flap 51*a* of the material portion 51 during the wrapping. The suction means 40 comprise a plurality of respective openings or slots 146 made and flowing out on a base wall 148 of the supporting element 104, opposite to the supporting wall 141, and in flow connection with a suction unit, for example a vacuum pump, of the wrapping machine 1. More precisely, the suction means comprise a duct 147 that is made inside the supporting element 104, extends in the advancing direction A and is provided with through openings 146. The duct 147 is in flow connection with the suction unit.

The supporting means 103 further include a couple of first moving belts 142 associated to the supporting element 104, which are flexible, endless and arranged for being abutted along respective operative tracts T by the material portion 51 during the wrapping. The first belts 142 are driven in such a way to move at the respective operative tracts T along the advancing direction A together with the load 100 exiting the wrapping unit 10 in order to allow the load 100 disengaging from the supporting element 4. Each first belt 142 is wrapped around a plurality of pulleys 143, 144, 145 rotating around respective axes that are orthogonal to the supporting wall 141, i.e. to the supporting plane M. Each first belt 142 has an abutting surface that is almost orthogonal to the supporting wall 141 and that can be engaged in the operative tract T by the material portion 51 wrapped around the load 100.

In the operative tracts T, the first belts 142 exit from the supporting element 4 on opposite sides of the latter in order to abut the material portion 51.

Inside the supporting element 104, each first belt 142 is wrapped around a respective first pulley 143, rotated by a respective first motor, a couple of respective second return pulleys 144 and a respective third return pulley 145, the return pulleys 144, 145 being rotatable and idle.

The operation of this variant of wrapping machine 1 of the invention is substantially identical to the one of the embodiment described above and shown in FIGS. 1-21, differing only in the diverse functionality of the second gripping means 121 of the insertion arm 11 and the first gripping means 104 of the supporting means 103.

During the wrapping procedure, the insertion arm 11 is positioned in the gripping position G1, the gripping bar 122 is moved in the extended position K1 in order to abut and hold the material 50 when the latter is stopped to allow the separation of the material portion 51 along the separation line, said portion 51 being drawn from the wrapping means 12 rotating. In such a way, the material flap generated by the separation, which corresponds to the initial flap of the subsequent material portion (still connected to the flexible and wrappable material 50 to be unwound from the reel 55), is held and blocked by the second gripping means 121. In particular, the gripping bar 122 pushes the film 50 against the counter element 163 of the supplying unit 30 and it is moved in the retracted position K2 after grabbing the material 50 for depression or suction.

At the end of the wrapping, and in particular in a setting step of a following wrapping, the insertion arm 11 is moved in the transferring position G2 in which the gripping bar 122 is moved in the extended position K1 to abut the bottom wall 148 of the supporting element 104 in order to transfer and give the initial flap 51*a* of the material portion 51 to the suction means 40 of the supporting element 104. For this purpose, the air suction through the openings of the gripping bar 122 is stopped and instead compressed air is emitted which push said initial flap 51*a* towards the respective openings of the suction means 40 of the supporting element 104 in which the air suction is activated in order to firmly hold the initial flap 51*a* of the material portion 51.

Figure 25:
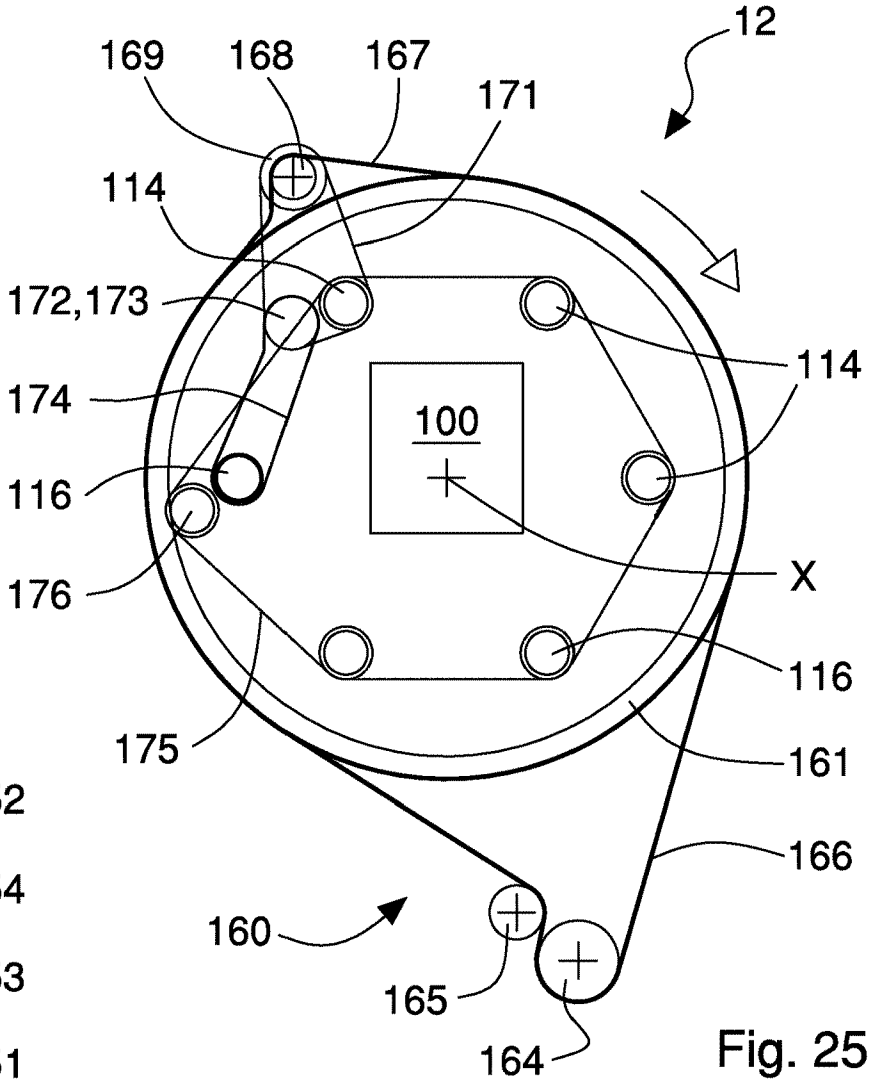
FIG. 25 is a schematic side view of the variant of the wrapping machine of FIG. 24 showing driving means of the wrapping means.
Figure 24:
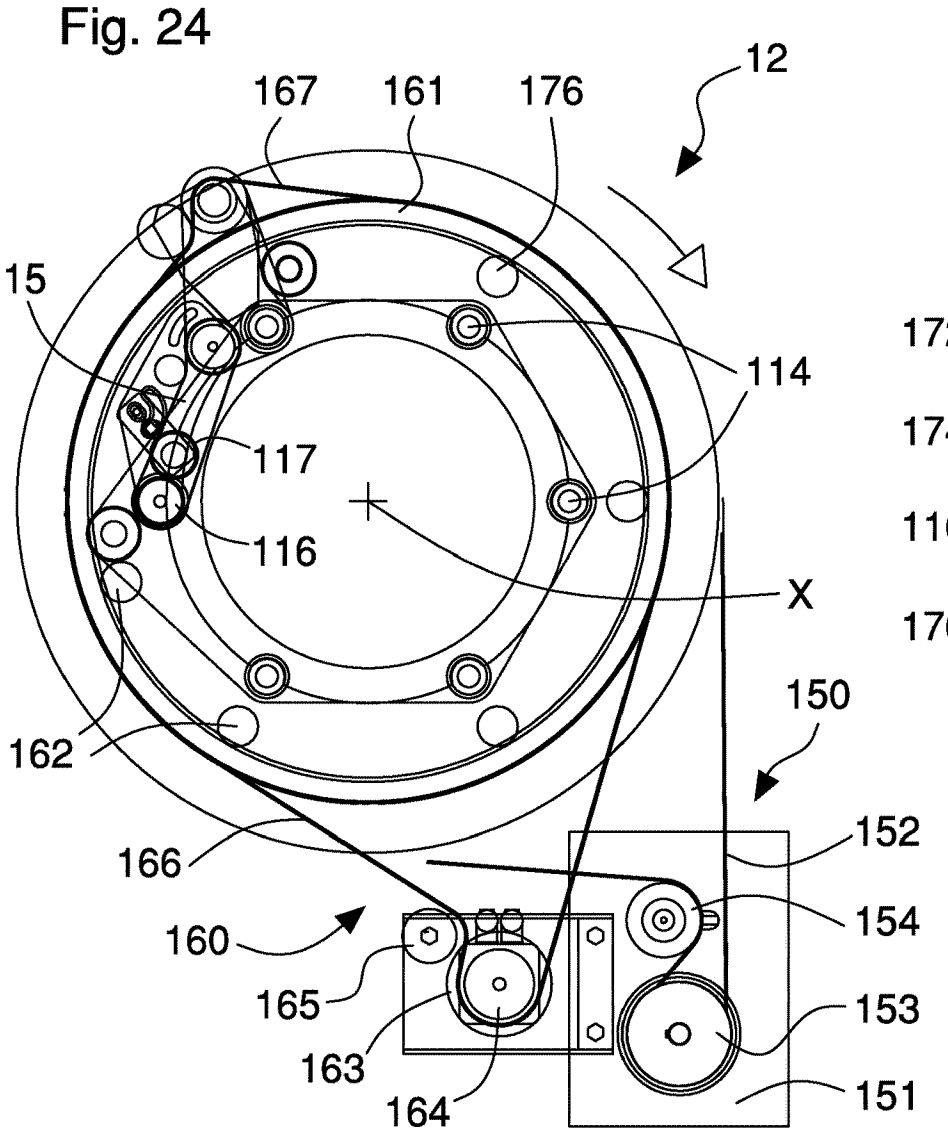
FIG. 24 is a schematic side view of a further variant of the wrapping machine of the invention showing wrapping means of the load.

The gripping bar 122 is then brought back in the retracted position K2 to allow the insertion arm 11 rotating from the transferring position G2 to the gripping position G1. With reference to FIGS. 24 and 25, a further variant of the wrapping machine 1 of the invention is shown which differs from the embodiment described above and shown in FIGS.

1 to 20 in the wrapping means 12 of the wrapping unit 10, wherein the wrapping rollers 114, mounted in a cantilever way on the supporting ring 13, and the first unwinding roller 116, mounted in a cantilever way on the unwinding arm 15, are motorized, i.e. rotated by respective driving means around the respective longitudinal axes, which are parallel to the wrapping axis X. More precisely, first driving means 160 are provided for rotating the wrapping rollers 114 and the first unwinding roller 116 and second driving means 150 are provided for rotating the supporting ring 13, rotatably supported by the frame means 9.

The second driving means 150 comprise, for example, a first rotating electric motor 151, which rotates a first driving belt 152 wrapped around the supporting ring 13 through a first driving pulley 153 and a first return pulley 154.

In the embodiment shown in the figures, the first driving means 160 comprise a transmission ring 161 that is mounted on the supporting ring 13, free to rotate around the wrapping axis X, by means of a plurality of small supporting rollers 162. A second rotating electric motor 163 rotates a second driving belt 166 that is wrapped around the transmission ring 161 through a second driving pulley 164 and a second return pulley 165. Around the ring, a third transmission belt 167 is wrapped which engages and rotates a first driven pulley 168 rotatably fixed to the frame means 9. To the first driven pulley 168 a third driving pulley 169 is coaxially fixed which, through a fourth driving belt 171, rotates one of the unwinding rollers 114 and a second driven pulley 172 that is fixed to the unwinding arm 15 and drives a fourth driving pulley 173 coaxially fixed thereto. The fourth driving pulley 173 rotates the first unwinding roller 116 of the unwinding arm 5 through a fifth driving belt 174. A sixth moving belt 175 wraps and connects the wrapping roller 114, driven by the fourth driving belt 171 to the remaining wrapping rollers 114 (and to a third return pulley 176). Preferably, the driving belts and the pulleys are of the toothed type in order to guarantee a precise and regular motion transmission.

The wrapping rollers 114 and the first unwinding roller comprise respective ring gears (not shown) around which the respective driving belts are wrapped and engaged.

Hence, the first driving means 160 of the wrapping machine of the invention allow rotating the wrapping rollers 114 and the unwinding roller 116 in an independent and autonomous way with respect to the supporting ring 13, i.e. in an independent and autonomous way with respect to the wrapping speed of the material portion 51 around the load 100.

The wrapping rollers 114 and the first unwinding roller 116 are rotated in order to facilitate the unwinding of the material portion 51 from the supplying unit 3 and the contextual wrapping of the said portion around the load 100. Moreover, by sticking to and moving the material portion 51 during the wrapping, the wrapping rollers 114 and in particular the first unwinding roller 116 (in combination with the second wrapping roller 117) also allow regulating the material tension especially in proximity of the load 100.

There is provided a variant, not shown in figures, in which the wrapping rollers 14 are free to rotate, i.e. they are idle and only the first wrapping roller 116 is rotated around its own longitudinal axis by the first driving means 160.

FIG. 26 shows another variant of the wrapping machine 1 of the invention which differs from the embodiment described above and shown in FIGS. 1 to 20 in the wrapping means 12 of the wrapping unit 10 which include one or more abutting belts 130 that are arranged, during the rotation of the supporting ring 13 around the wrapping axis X, to abut and to wrap around the wrapping rollers 14 that progressively are positioned on an upper arc 13*a* of said supporting ring 13 that is above the load 100, in order to maintain the material portion 51 strictly adherent to the wrapping rollers 14 and in particular to prevent the disengagement of the terminal flap 51*b* of the portion 51 after the latter exits the supplying unit 3. Preferably, there is provided a plurality of wrapping belts 130 that are arranged parallel and spaced from each other along the direction of the wrapping axis X in order to stick the material on the wrapping rollers 14 for the whole width of the material. Each abutting belt 130 is endless and wound around two lower return pulleys 131 and two upper return pulleys 132, fixed to the frame means 9 of the machine in such a way to stick to the wrapping rollers 14 on the upper arc 13*a* of said supporting ring 13. The abutting belts 130 are moved by the wrapping rollers 14 in the same direction as the rotation direction of the supporting ring 13, i.e. the wrapping direction of the material portion 51 around the load 100.

With reference to FIG. 27, still another variant of the wrapping machine 1 of the invention is provided which differs from the previously described embodiment in the unwinding means 32 and the cutting means 80 of the supplying unit 30 and in the insertion arm 11.

In this variant of the machine, the unwinding means 32 comprise a couple of pre-stretching rollers 33, 34, motorized and capable to unwind and pre-stretch the material 50, at least one return roller 35 to deflect the material 50 from the reel towards the pre-stretching rollers 33, 34 and a couple of pulling rollers 136, 137 arranged downstream of the pre-stretching rollers 33, 34 to dispense the material portion 51 to the wrapping unit 10.

The pre-stretching rollers comprise a first fast roller 33 positioned downstream of a second slow roller 34 in such a way to stretch or elongate the flexible and wrappable material, i.e. the film 50, by a preset percentage (according to rotation speed difference between the two rollers). The pre-stretching rollers 33, 34 are rotated by at least one motor and are abutted by respective abutting rollers 133 and 134, for example mounted on an elastic or adjustable support not shown, which assure the right adhesion of the material 50 to the said pre-stretching rollers 33, 34.

The pulling rollers comprise a first motorized pulling roller 136 and a second idle pulling roller 137 mounted on a respective oscillating arm 138 and therefore movable between an operative position, wherein the second pulling roller 137 presses the material 50 against the first pulling roller 136 to allow the latter maintaining under tension the material tract between the first pre-stretching roller 33 and the pulling rollers 136, 137, and a disengagement position, wherein said second pulling roller 137 is spaced from the first pulling roller 136 in order to allow the rotation of the insertion arm 11, as will be better explained in the following description.

The cutting means 80 are arranged between the two pulling rollers 136, 137 and the first pre-stretching roller 33 and comprise a cutting roller 181 rotating around a respective longitudinal axis that is transversal to the unwinding direction of the material; the cutting roller 181 is provided with a blade suitable to transversally cut or shear the material 50 so as to obtain the material portion 51 50 having a suitable length.

The free of the insertion arm 11 is provided with second gripping means 221 comprising a gripping bar 222 that has an shape elongated and transversal to the material 50 and is provided with air suction means capable to hold by depression or suction the initial flap 51*a* of the material portion 51 that is generated as a result of the cut executed by the cutting roller 81. The gripping bar 222 has, for example, a quadrangular cross-section and has an abutting wall for the material 50 on which a plurality of openings of the suction means are carried out that are in flow connection with a suction unit, for example a vacuum pump, of the wrapping machine 1. The gripping bar 222 further has a counter portion 222*a* having a formed shape which receives the material tract that is sheared by the cutting roller 181.

It should be noted that the cut makes the terminal flap 51*b* of the portion 51 of material 50 that is being wrapped around the load 100 and the initial flap 51*a* of the subsequent portion 51 of material 50 to be wrapped around a following load 100, said initial flap 51*a* being held by the second gripping means 221 of the insertion arm 11, positioned in the gripping position G1.

In this variant, the insertion arm 11 also includes an insertion blade 228 positioned at the second gripping means 221 and movable along the insertion arm 11 so as to insert the initial flap 51*a* of the portion 51 between the two supporting elements 4 of the first gripping means positioned in the opening position B2, when the insertion arm 11 is positioned in the transferring position G2 (dashed line in FIG. 27).

It should be noted that in the shown variant, the supporting elements 4 of the supporting means 3 (that act also as first gripping means) do not include mobile abutting belts for the material.

The insertion blade 228 is linearly moved by a respective linear actuator 229, for example a pneumatic cylinder of known type.

In order to allow the insertion arm 11 rotating between the gripping position G1 and the transferring position G2 for transferring the initial flap 51*a*, held by the second gripping means 221, to the first gripping means 4, the second pulling roller 137 is moved by rotating the respective oscillating arm 138 in the disengagement position, wherein the second pulling roller 137 is spaced from the first pulling roller 136 and does not interfere with the gripping bar 222 and the insertion blade 222 of the insertion arm 1.

Figure 28:
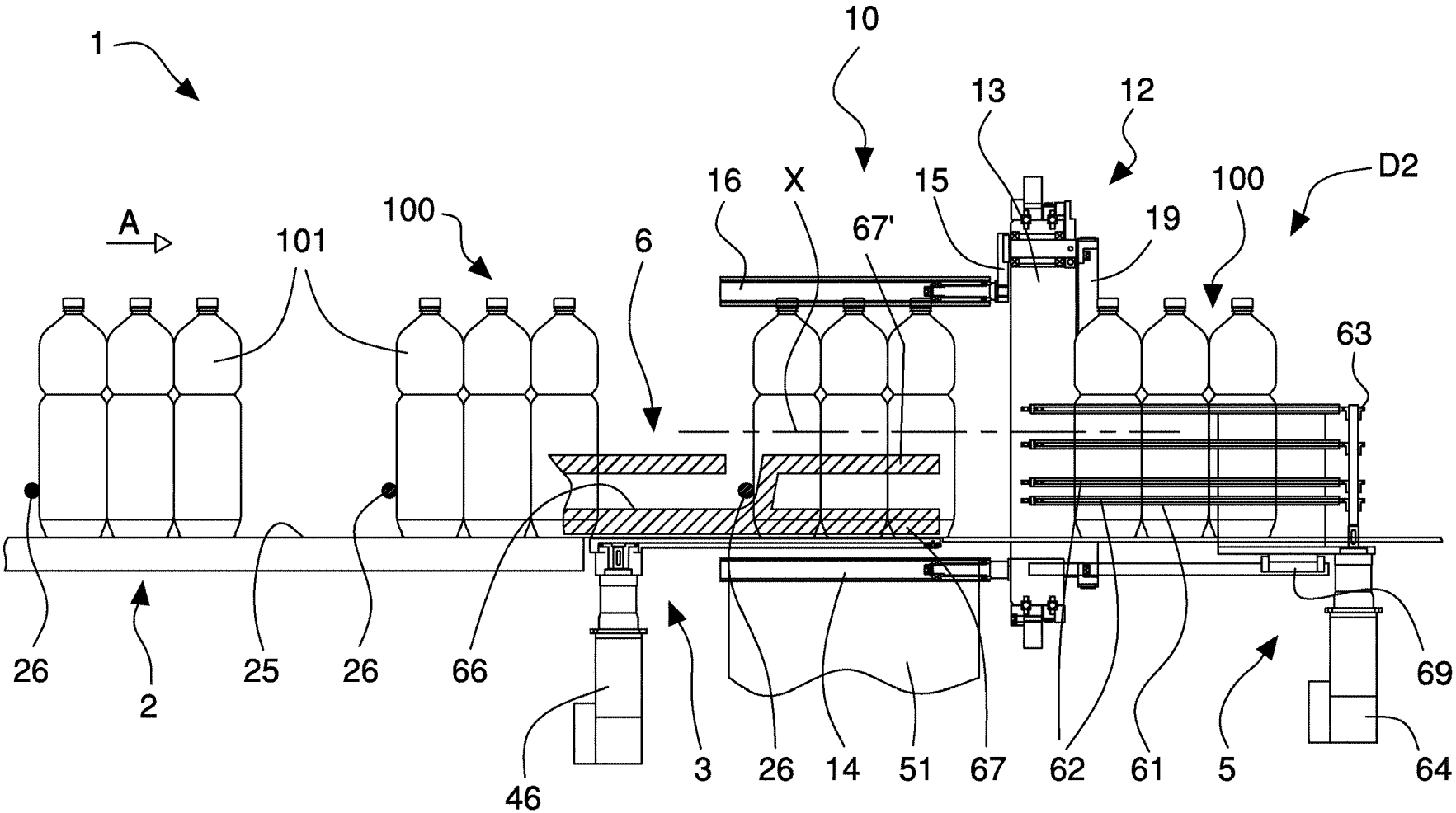
FIG. 28 is a schematic front view of a further variant of the wrapping machine of the invention in an operating step and being associated with a load made of a group of products to be wrapped in a bundle.
Figure 29:
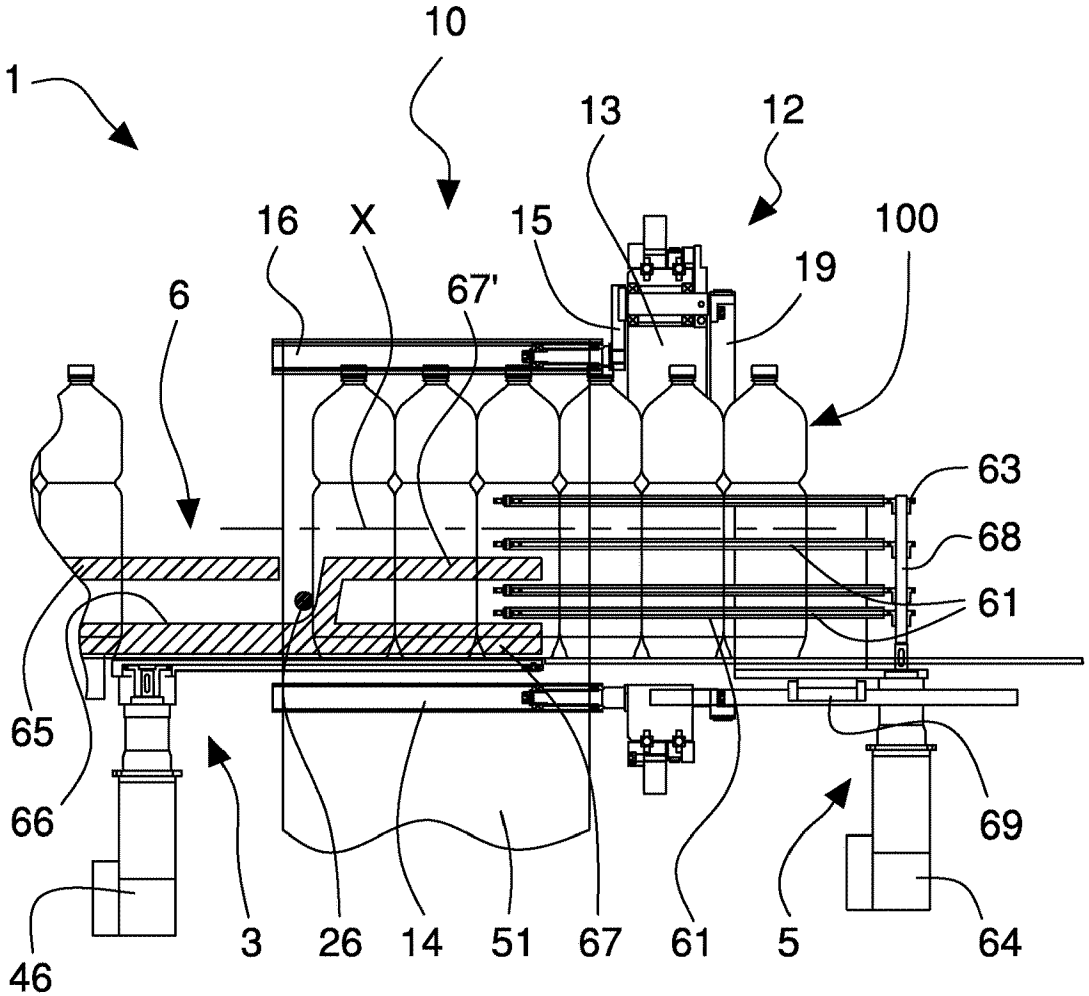
FIG. 29 is a view as the one of FIG. 28 that shows the wrapping machine in a further operating step.
Figure 30:
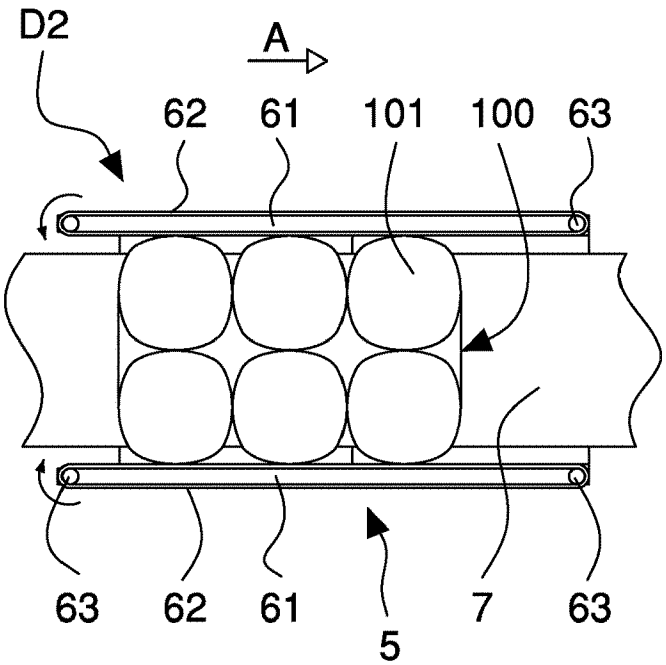
FIG. 30 is a schematic top view of guiding means of the wrapping machine of FIG. 24.

With reference to FIGS. 28 to 30, a variant of the wrapping machine 1 of the invention is shown that is arranged to wrap a load 100 consisting of a group of products 101, for example containers 101 for liquids, with a flexible and wrappable material 50 made of an extensible plastic film so as to form a respective load or bundle.

The load 100 is moved along the first conveyor means 2 comprising a sliding plane 25, which is coplanar to a supporting plan M formed by the supporting means 3, and pushing means 26 movable and arranged to abut and push the load or group 100 of products spaced from each other along the advancing direction A. More precisely, the pushing means, of known type and not shown in details in the figures, comprise a plurality of pushing crossbeams 26 whose ends are mounted on respective endless moving chains, movable along an operative tract in order to abut and therefore push respective loads or groups 100 of products along the advancing direction A and towards the wrapping unit 10. The second conveyor means 7, positioned downstream of the wrapping unit 10 for supporting and moving the loads along the advancing direction A that come out of the wrapping machine 1, comprise for example a motorized belt or conveyor of known type and not shown in detail in the figures.

This variant of the wrapping machine further differs from the embodiment described above and shown in FIG. 1 in that it includes guiding means 5 for abutting sidewalls of the loads 100 or the groups of products and guiding the latter ones exiting the wrapping unit 10 and disengaging from the supporting means 3 once wrapped. The products forming the group or load to be wrapped are put on the supporting plane M formed by the supporting means 3 and the conveyor means 2, 7, but they are unstable and they must be supported in the exiting movement from the wrapping unit 10.

For the same reason, containment means 6 are provided for abutting and laterally guiding the group 100 of products when moved by the first conveyor means 2 along the advancing direction A inside the wrapping unit 10. The containment means 6 comprise a couple of lateral panels 65, fixed to frame means 9 of the machine 1, having an elongated shape and arranged parallel and opposed so as to abut the load 100 at opposite sides thereof.

In particular, each lateral panel 65 has a through opening 66 for allowing the pushing crossbeams 26 passing through and moving and a couple of guiding protrusions 67, 67' having a flat and elongated shape, arranged for laterally supporting during the wrapping the products to be wrapped by the material portion 51. The flat and elongated shape of the guiding protrusions 67, 67' allows the latter ones to easily disengage from the load 100 at the end of the wrapping when the load is pushed out of the wrapping unit 10, for example by an incoming load or group 100 of products to be wrapped, and in cooperation with the guiding means 5.

The guiding means 5 are movable along the advancing direction A between a seizing position D1, in which they abut the load or the group 100 of products inside the wrapping unit 10, and a releasing position D2, in which said guiding means 5 are spaced from the wrapping unit 10 and transfer the load or the group 100 of products to second conveyor means 7.

The guiding means 5 comprise one or more couple of abutting rods 61, for example four couples, the abutting rods 61 of each couple being parallel to each other and to the advancing direction A and opposed, spaced apart by a distance equal to the width or transversal dimension of the load in order to abut sidewalls thereof.

The couple of abutting rods 61 are vertically spaced from each other in order to abut and vertically support loads or products having different dimension and size. The abutting rods 61 are supported by a couple of uprights 68 that are substantially vertical and fixed to a supporting carriage 69 movable linearly along the advancing direction A, in both the directions, between the seizing position D1 and the releasing position D2. The abutting rods 61 are fixed in an adjustable way along the uprights 68, according to shape and dimensions of the load or products.

The abutting rods 61 are provided with respective second moving belts 62 that are endless, arranged to abut opposite sidewalls of the products and rotated in order to move said load 100 along the advancing direction A exiting the wrapping unit 10. More precisely, the guiding means 5 cooperate in the transfer of the load 100 from the wrapping unit 10 to the second conveyor means 7.

With particular reference to FIG. 30, the second belt 62 of each abutting rod 61, having for example a flat shape, is wrapped around a couple of respective pulleys 63 rotating around respective axes that are orthogonal to the supporting plane M. At least one of the pulleys is rotated by a second motor 64 fixed to the supporting carriage 69. The second belt 62 has a respective abutting surface that is substantially orthogonal to the supporting plane M and engages a sidewall of the load 100. In the shown embodiment, the second belts 62 of the abutting rods 61 that abut the same sidewall of the load 100 (i.e. the abutting rods 61 aligned and vertically superimposed at the same side of the load 100, fixed to the same upright 68) are driven by a same second motor 64, for example an electrical rotating motor. The operation of this variant of the wrapping machine 1 of the invention differs from the operation of the machine of FIGS. 1 to 20 in that the guiding means 5 are moved, at the end of the wrapping, from the releasing position D2 to the seizing position D1 so as to abut and laterally support the load 100, i.e. the group of products, exiting the wrapping unit 10. For example, the load 100 is pushed along the advancing direction A out of the wrapping unit 10 by the subsequent load or group 100 of products positioned upstream and in turn pushed and moved by a respective pushing crossbeam 26 (FIG. 29).

The abutting rods 61 of the guiding means 5 enter between the guiding protrusions 67, 67' of the couple of lateral panels 65 of the second guiding means 6.

The second moving belts 62 of the abutting rods 61 of the guiding means 5 are driven in order to move the load 100 in the advancing direction A. At the same time, the same guiding means 5 are moved from the seizing position D1 to the releasing position D2. In this way, the load 100 is easily transferred from the supporting means 3 inside the wrapping unit 10 to the second conveyor means 7, disengaging from the supporting elements 4.

Figure 32:
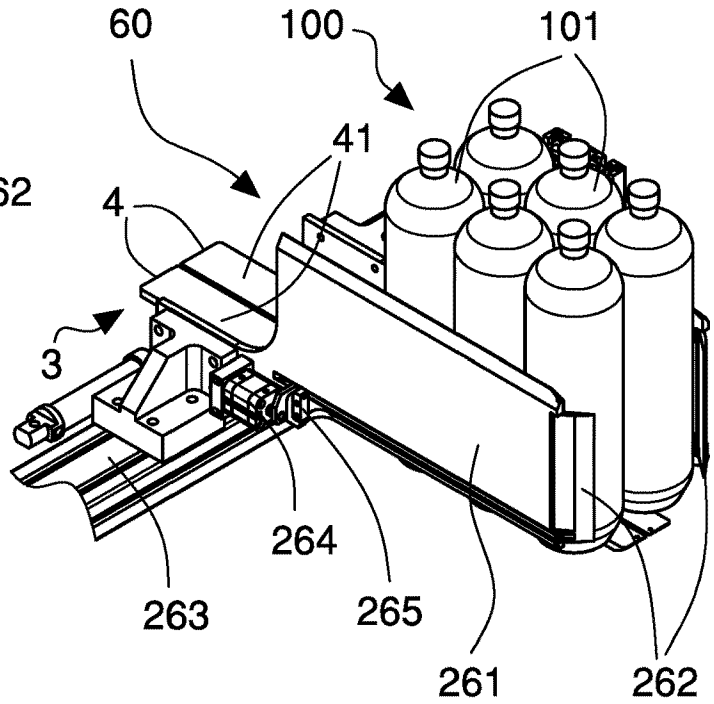
FIGS. 31 and 32 are respectively a side view and a perspective view of supporting means and containment means of the load of another variant of the wrapping machine of the invention.
Figure 31:
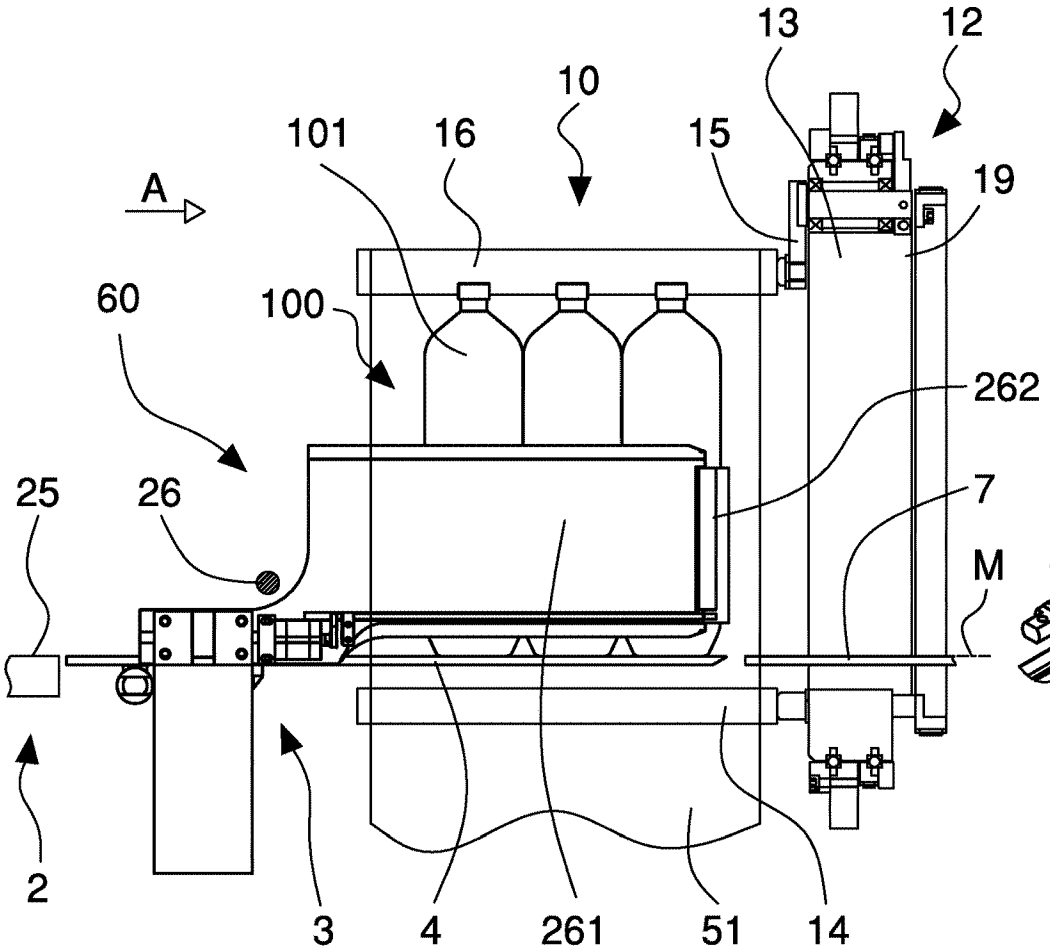
Figure 33:
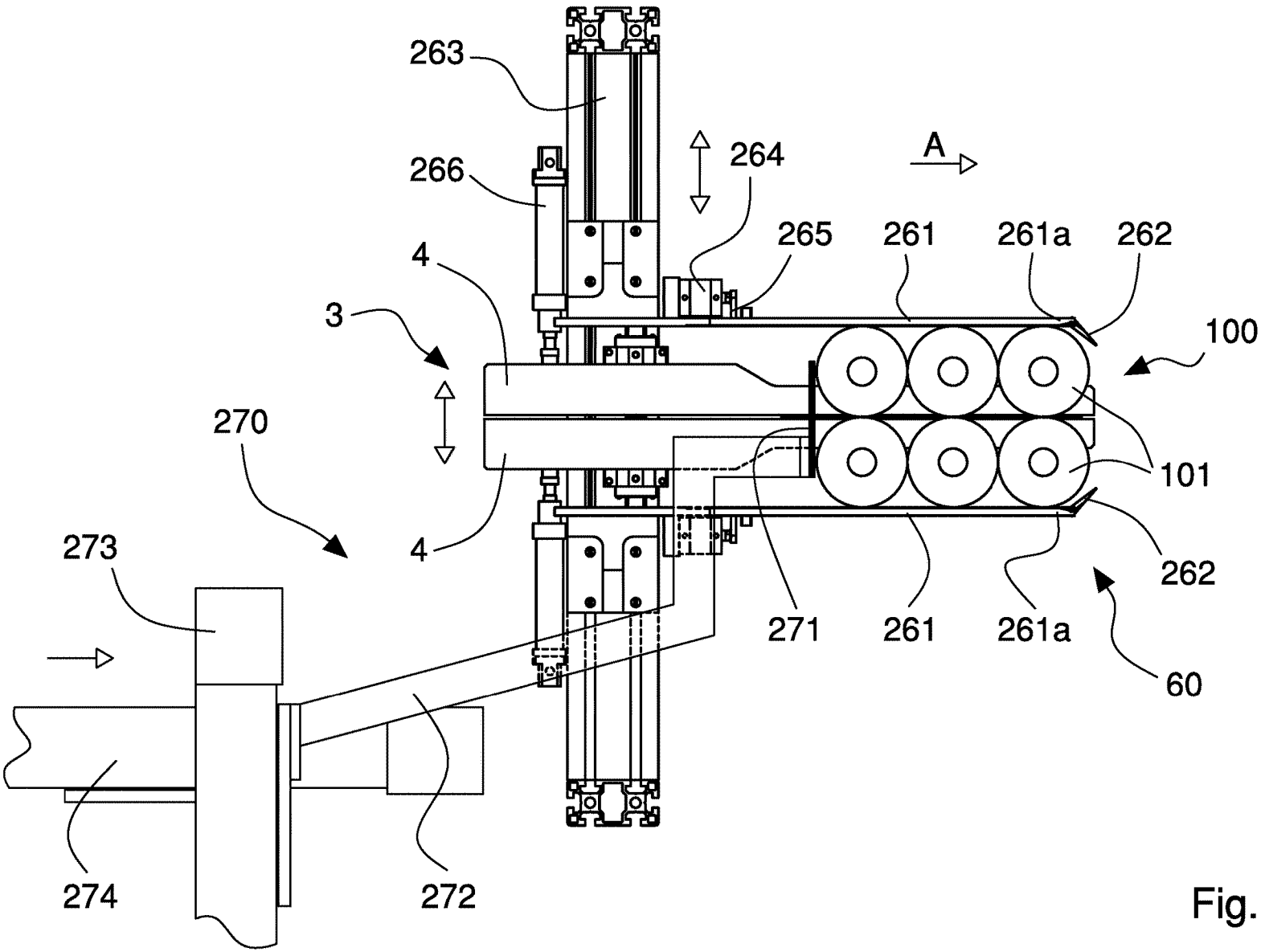
FIG. 33 is a top view of the supporting means and the containment means of the variant of FIGS. 31 and 32.

With reference to FIGS. 31 to 33, another variant of the wrapping machine 1 of the invention is shown that is arranged for wrapping a load 100 consisting of a group of products 101, which differs from the embodiment described above and shown in FIGS. 28 to 30 in the different containment means 60 of the products 101 and in that it does not include guiding means arranged to abut sidewalls of the loads 100 or the groups of products and to guiding the latter one exiting the wrapping unit 10.

Also in this variant, the products 101, which form the group or load to be wrapped, are positioned on the supporting plane M formed by the supporting means 3 and the conveyor means 2, 7, but since they are unstable, they must be supported by the containment means 60 when entering the wrapping unit 10 and during the wrapping step. The containment means include a couple of lateral panels 261 that abut the sidewalls of the products 101 inside the wrapping unit 10. The transversal position, i.e. along a direction orthogonal to the advancing direction A of the products, can be adjusted according to the dimensions of products 101 or bundle 100 being formed. For this purpose, the two lateral panels 261 are mounted on a lateral guide 263 along which they can be moved and therefore opportunely blocked.

Each lateral panel 261 comprises a terminal edge 261*a* adjacent to the second conveyor means 7 (provided downstream of the wrapping unit 10 in order to support and move the loads along the advancing direction A and exiting the wrapping machine 1) to which a respective abutting door 262 is rotatably fixed that is movable to block the products 101 moving along the advancing direction A, in particular during the wrapping. More precisely, each abutting door 262 is fixed to the terminal edge 261*a* of the respective lateral panel 261 in such a way to rotate around a substantially vertical axis, between a closing position, wherein the is rotated and turned towards the opposite lateral panel 261 in order to block the products 101 moving along said advancing direction A, and an opening position, wherein the abutting door is almost aligned to the respective lateral panel 261 in order to allow the products 101 moving along the advancing direction A and therefore coming out from the wrapping unit 10. A respective actuator 264, for example of pneumatic type, is provided for rotating each abutting door 262 by lever means 265.

In this variant of the wrapping machine 1, the first gripping means 4 are integrated with the supporting means 3 and comprise two supporting elements 4 that are adjacent and opposed and form the supporting plane M. The supporting elements 4 are moved by respective linear actuators 266, for example pneumatic cylinders or linear electric motors, transversally to the advancing direction A, between the closing position B1 and the opening position B2.

With particular reference to FIG. 33, the wrapping machine 1 includes further pushing means 270 acting upstream of the product group 101 that are partially introduced inside the wrapping unit 10 by the pushing means 26 (pushing crossbeams) of the first conveyor means 2. The further pushing means 270 push the products 101, slidably supported by the supporting walls 41 of the supporting elements 4 and by the lateral panels 261, until compacting them against the abutting doors 262 positioned in the closing position, which in this way form a fixed reference line for the following wrapping of the products 101 with the material 50.

The further pushing means 270 comprise a pushing plate 271 suitable to abut the sidewalls of the products 101 farther from the abutting doors 262. The pushing plate 271 is supported by a supporting lever 272 having a formed shape and moved by actuating means 273, 274 in such a way to disengage from the products 101 and from the wrapping unit 10, after compacting, without colliding with a subsequent product group 101 advancing along the supporting means 3. The actuating means include, for example, a first linear actuator 273 that supports and linearly moves the supporting lever 272 along a direction transversal to the advancing direction A and a second linear actuator 274 that supports and moves the first linear actuator 273 parallel to the advancing direction A. By controlling in a suitable way the two linear actuators 273, 274 it is possible to move the supporting lever 272 and thus the pushing plate 271 with a suitable desired interpolated trajectory, in particular exiting the wrapping unit 10.

The operation of this variant of wrapping machine 1 provides to transfer the group of products 101 from the first conveyor means 2 to the supporting means 3 of the wrapping unit 10 by means of the pushing crossbeams 26. The further pushing means 270 operate in order to compact and push the products 101 inside the wrapping unit 10 against the abutting doors 262 of the containment means 60 positioned in a closing position. The lateral panels 261 keep the products 101 (for example bottles) in a stable and erected position both during the transfer on the supporting means 3 and during the wrapping with the portion 51 of material 50. Before starting the wrapping, the pushing plate 271 of the further pushing means 270 is disengaged from the products and removed from the wrapping unit 10 in order to not to interfere with the material being unwound.

During the operation of the wrapping means 12, the portion 51 of material 50 is wrapped around the product group 101 and also around the lateral panels 261 and the abutting doors 262. However, thanks to the elasticity of the material 50 and the flat and elongated shape of the lateral panels 261 and the abutting doors 262, it is possible to easily disengage the bundle or load 100 from the containment means 60 (with the abutting doors 262 positioned in the opening position) at the end of the wrapping and to transfer the bundle or load from the supporting means 3 to the second conveyor means 7. In particular, the load 100 wrapped with the material is pushed out of the wrapping unit 10 along the advancing direction A by an incoming load or group of products 101 to be wrapped, positioned upstream and in turn pushed and moved by a respective pushing crossbeam 26.

Figure 34:
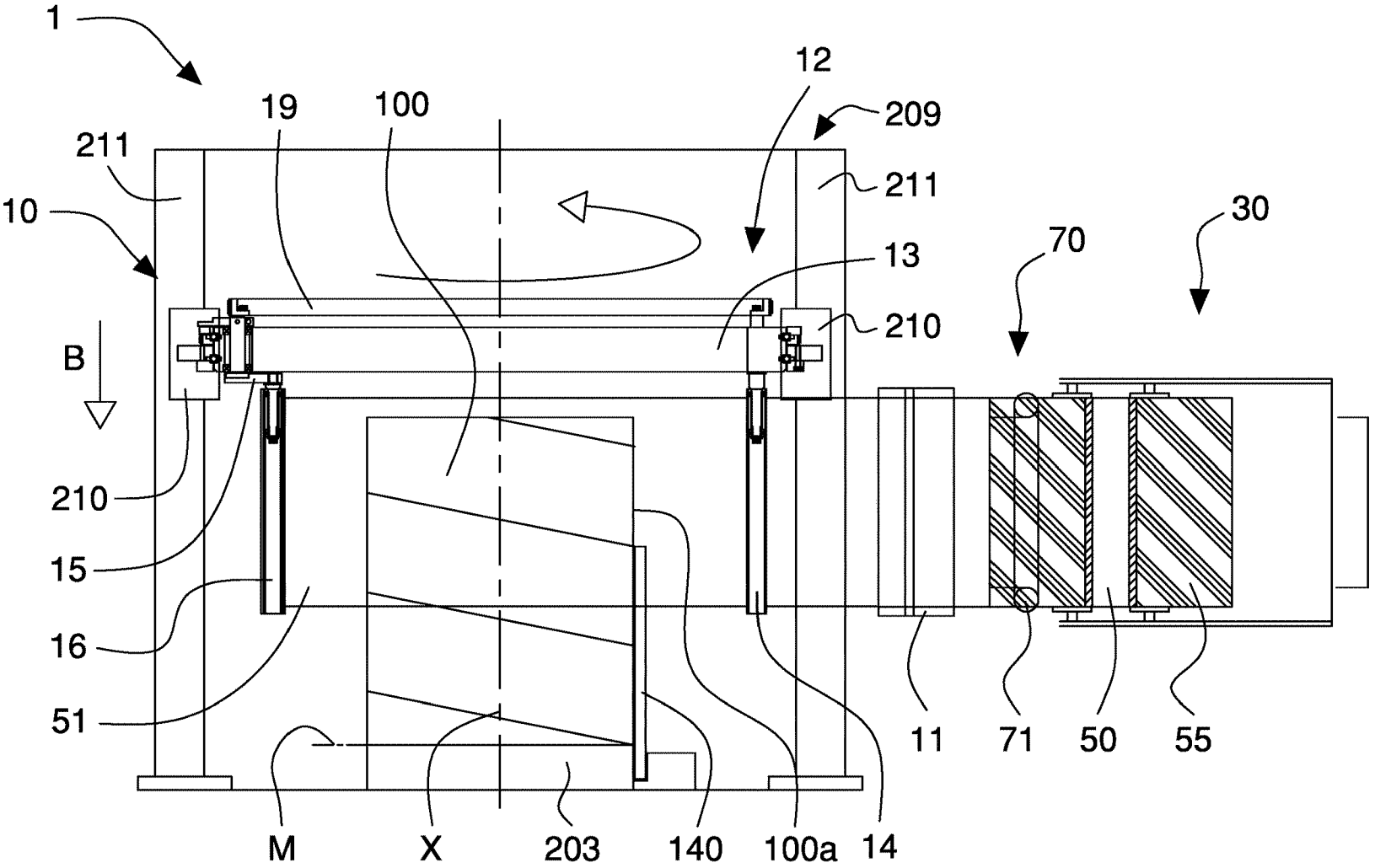
FIG. 34 is a schematic side view of another further variant of the wrapping machine.

FIG. 34 schematically shows a further version of the wrapping machine 1 of the invention wherein the wrapping unit 10 is mounted movable on frame means 209 of the machine so as to be movable along a motion direction B that is vertical and parallel to the wrapping axis X. More precisely, the wrapping means 12, besides rotating around the wrapping axis X, are movable along the latter with an alternating motion so as to wrap a load 100 with a plurality of superimposed turns or bands of a portion 51 of flexible and wrappable material, in particular of an extensible plastic film, having a preset length.

The wrapping means 12 are supported by carriage means 210, slidably fixed to uprights 211 of the frame means 209. The carriage means 210 and the wrapping means 12 are moved along the motion direction B by actuator means of known type and not shown in figures.

In this variant of the wrapping machine 1, the supporting means 203 comprise a fixed table or a roller conveyor on which the load 100 is positioned motionless during the wrapping. The roller conveyor, if motorized, also allows the load 100 to enter and exit into/from the wrapping machine.

The first gripping means include pliers means 140 positionable adjacent to the supporting means 203 and to a sidewall 100*a* of the load 100 in order to hold and block the initial flap 51*a* of the material portion 51 transferred by the insertion arm 11. In particular, the pliers means 140 are movable between an operating position, in which they are positioned side by side to said sidewall 100*a* of the load 100 in order to receive and hold said initial flap 51*a*, and a non-operating position, in which said pliers means 140 are disengaged from the load 100 and the material 50 which is wrapped thereon in order to allow the load 100 exiting the wrapping machine 1.

The supplying unit 30 is arranged, for example, adjacent to the frame means 109 of the wrapping machine, in such a position that allows the insertion arm 11, in the transferring position G2, to reach the pliers means 140 for transferring the initial flap 51*a* of the material portion 51. In that way, during the wrapping of the load 100, an almost depleted reel 55 of material can be easily replaced with a new reel 55 of material without the need to stop the operation, thanks to the joining means 85 of the supplying unit 30. In fact, the joining means allow joining the head flap of the new reel to the tail flap of the almost depleted reel. The depleted reel can be removed from the supplying unit 30 and replaced with a new reel during the operation of the wrapping machine, which uses the other reel. Also in this case, thanks to the first gripping means 140, which allow fixing the initial flap 51*a* of the portion of material 51 in an preset and repeatable initial position on the load 100, and thanks to the wrapping means 12, which allow wrapping a material portion 51 having a preset length (portion provided by the supplying unit 30), it is possible to wrap a load 100 using a flexible and wrappable material 50, typically a plastic film, that is printed and/or decorated, i.e. provided with writings, drawings, decorations or the like. In fact, the portion 51 can be positioned in a precise and reproducible way around the load 100, this allowing positioning writings, drawings, decorations or the same in the desired positions on the load 100.

The invention claimed is:

1. A wrapping machine for wrapping a flexible and wrappable material (50) around a load (100), the wrapping machine comprising:

a wrapping unit (10) to wrap a material portion (51) of the flexible and wrappable material (50) having a preset length around the load (100); and a supplying unit (30) to supply the material portion (51) having the preset length to said wrapping unit (10), wherein said wrapping unit (10) includes a wrapping device (12) to unwind the material portion (51) from said supplying unit (30) and to wrap the material portion around the load (100), wherein said wrapping device (12) includes:

a supporting ring (13) rotatable around a wrapping axis (X) and provided with a plurality of wrapping rollers (14; 114) mounted thereon angularly spaced apart from each other and rotatable around respective longitudinal axes, said wrapping rollers being parallel to the wrapping axis (X);

an unwinding arm (15) having a first end (15*a*) rotatably fixed to said supporting ring (13) and a second end (15*b*) supporting at least an unwinding roller (16, 17; 116, 117) arranged to abut and guide the material portion (51) of the flexible and wrappable material (50) towards the load (100) during the wrapping thereof, said unwinding arm (15) being movable to bring near and/or move away said unwinding roller (16, 17; 116, 117) to/from the load (100) during the wrapping, wherein said supporting ring (13), by rotating in a first wrapping step, unwinds and draws the material portion (51) from said supplying unit (30), wraps with said unwinding arm (15) a first tract of the material portion (51) around the load (100), and wraps a second tract of the material portion (51) around said wrapping rollers (14; 114), and in a second wrapping step, said supporting ring (13) wraps with said unwinding arm (15) the second tract of the material portion (51), drawn and unwound from said wrapping rollers (14; 114), around the load (100) to complete the wrapping of the load, and wherein said unwinding arm (15) is movable between a first operative position (E1), where said unwinding roller (16, 17; 116, 117) is further from the load (100) to deflect the material portion (51) towards the load in the first wrapping step, and a second operative position (E2), where said unwinding roller (16, 17; 116, 117) is closer to the load (100) to deflect thereon a terminal flap (51*b*) of the material portion (51).

2. The wrapping machine according to claim 1, wherein said unwinding arm comprises a brush fixed to said second end and arranged to abut and stick the material portion to the load in the second operative position.

3. The wrapping machine according to claim 1, wherein said wrapping device further includes a driving ring adjacent to said supporting ring and rotatable around the wrapping axis separately and independently from said supporting ring, said driving ring being connected to said first end of said unwinding arm to rotate said unwinding arm at least between the first operative position and the second operative position.

4. The wrapping machine according to claim 1, wherein said wrapping rollers and/or said unwinding roller are rotatable around respective longitudinal axes by a first driving system.

5. The wrapping machine according to claim 1, further comprising at least one endless abutting belt that is wound around a plurality of return pulleys, which are fixed to a frame of the wrapping machine, and around said wrapping rollers, which are progressively positioned during the rotation of said supporting ring on an upper arc of said supporting ring that is above the load to maintain the material portion adherent to said wrapping rollers and prevent disengagement of the terminal flap of the material portion from said wrapping rollers after the terminal flap exits from said supplying unit.

6. The wrapping machine according to claim 1, further comprising a supporting device to support the load and a first gripping device adjacent to the load and arranged to grab and block an initial flap of the material portion during the wrapping.

7. The wrapping machine according to claim 6, wherein said wrapping unit further includes an insertion arm movable and arranged to grab the initial flap coming out from said supplying unit and to transfer the initial flap to said first gripping device to be grabbed and blocked thereby, in an initial setting step of the wrapping.

8. The wrapping machine according to claim 7, wherein said insertion arm comprises a first terminal portion rotatably fixed to a frame of the wrapping machine and a second terminal portion provided with a second gripping device suitable to hold the initial flap of the material portion, and wherein said insertion arm is rotatable between a gripping position, where said insertion arm is adjacent to said supplying unit for grabbing the initial flap, and a transferring position, where said insertion arm is adjacent to said supporting device and/or to the load to transfer the initial flap to said first gripping device.

9. The wrapping machine according to claim 6, wherein said supporting device includes said first gripping device, which comprises two supporting elements of said supporting device, said supporting elements being adjacent and opposed, and provided with respective supporting walls forming a supporting plane for the load, and wherein said supporting elements are movable between a closing position, where said supporting elements abut each other to block the initial flap, and an opening position, where said supporting elements are spaced apart to allow the initial flap to be inserted or released.

10. The wrapping machine according to claim 9, wherein each of said supporting elements comprises a respective first belt, which is flexible, endless and arranged to be abutted along an operative tract by the material portion during the wrapping, said first belts being driven so as to move at the operative tracts along an advancing direction together with the load exiting said wrapping unit such that said support elements disengage from the load.

11. The wrapping machine according to claim 6, wherein said supporting device (103) includes said first gripping device comprising at least one supporting element provided with a supporting wall arranged to support the load and forming a supporting plane for the load, and an air suction system arranged to suck and hold the initial flap of the material portion during the wrapping.

12. The wrapping machine according to claim 11, wherein said supporting element of said supporting device comprises a plurality of first belts, which are flexible, endless and arranged to be abutted along respective operative tracts by the material portion during the wrapping, said first belts being driven so as to move at the respective operative tracts along an advancing direction together with the load exiting said wrapping unit such that said supporting element disengages from the load.

13. The wrapping machine according to claim 6, wherein said supporting device comprises table means or roller conveyor means arranged at least to support the load, and wherein said first gripping device comprises pliers, positionable adjacent to a sidewall of the load and arranged to hold and block the initial flap of the material portion that is transferred by an insertion arm.

14. The wrapping machine according to claim 1, wherein said supplying unit includes:

a supporting and moving device to support and rotate at least one reel of the flexible and wrappable material;

an unwinding assembly comprising a plurality of rollers at least to unwind the flexible and wrappable material from the reel; and a cutting device to form on the flexible and wrappable material a weakening line or a cutting line respectively for facilitating a separation of, or for separating, the material portion from the flexible and wrappable material unwound from the reel.

15. The wrapping machine according to claim 14, wherein said supporting and moving device comprises a first supporting and moving element to support and rotate a first reel of the flexible and wrappable material and a second supporting and moving element to support and rotate a second reel of the flexible and wrappable material, and wherein said supplying unit further comprises joining device to join a head flap of one of the first and second reels that is new to a tail flap of another of the first and second reels that is almost depleted.

16. The wrapping machine according to claim 1, further comprising a first conveyor to support and move the load along an advancing direction towards said wrapping unit and onto a supporting device of the load, and a second conveyor to support and move the load exiting from the wrapping machine.

17. The wrapping machine according to claim 1, further comprising a guiding assembly to abut sidewalls of the load and to guide the load exiting from said wrapping unit and disengaging from a supporting device of the load, wherein said guiding assembly is movable along an advancing direction of the load between a seizing position, where said guiding assembly abuts the load inside said wrapping unit, and a releasing position, where said guiding assembly is spaced apart from said wrapping unit.

18. The wrapping machine according to claim 1, further comprising a containment device to abut at least sidewalls of the load to guide the load when moving along an advancing direction through said wrapping unit and/or to support and restrain the load during the wrapping thereof with the material portion of the flexible and wrappable material.

19. The wrapping machine according to claim 1, further comprising a frame to support said wrapping unit, the wrapping axis being parallel to a supporting plane of the load.

20. The wrapping machine according to claim 1, further comprising a frame slidably supporting said wrapping unit to be movable along a motion direction parallel to the wrapping axis of said wrapping device.

* * * * *